US010538414B2

(12) United States Patent
Uchida et al.

(10) Patent No.: US 10,538,414 B2
(45) Date of Patent: Jan. 21, 2020

(54) ELEVATOR SAFETY SYSTEM

(71) Applicant: MITSUBISHI ELECTRIC CORPORATION, Chiyoda-ku (JP)

(72) Inventors: Yoshiyuki Uchida, Chiyoda-ku (JP); Kazunori Washio, Chiyoda-ku (JP); Kazuki Hamada, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 252 days.

(21) Appl. No.: 15/579,388

(22) PCT Filed: Jun. 15, 2015

(86) PCT No.: PCT/JP2015/067143
§ 371 (c)(1),
(2) Date: Dec. 4, 2017

(87) PCT Pub. No.: WO2016/203513
PCT Pub. Date: Dec. 22, 2016

(65) Prior Publication Data

US 2018/0179021 A1 Jun. 28, 2018

(51) Int. Cl.
*B66B 1/28* (2006.01)
*B66B 5/02* (2006.01)
(Continued)

(52) U.S. Cl.
CPC ..... *B66B 5/02* (2013.01); *B66B 1/28* (2013.01); *B66B 1/3423* (2013.01);
(Continued)

(58) Field of Classification Search
CPC ..... B66B 5/00; B66B 5/02; B66B 1/3453; B66B 5/0018; B66B 1/28; B66B 1/3423;
(Continued)

(56) References Cited

U.S. PATENT DOCUMENTS 5,360,952 A * 11/1994 Brajczewski ..... B66B 1/34 187/248
5,854,454 A * 12/1998 Upender ..... H04L 12/40163 187/247
(Continued)

FOREIGN PATENT DOCUMENTS

EP 1 864 935 A1 12/2007
EP 2 634 129 A2 9/2013
(Continued)

OTHER PUBLICATIONS

International Search Report dated Sep. 15, 2015 in PCT/JP2015/067143 filed Jun. 15, 2015.
(Continued)

*Primary Examiner* — Anthony J Salata
(74) *Attorney, Agent, or Firm* — Xsensus LLP

(57) ABSTRACT

Provided is an elevator safety system including: a plurality of communication controllers configured to communicate, over a network, signals including a safety control signal; a control device connected to a first communication controller, which is one of the plurality of communication controllers, and configured to execute operation control of the elevator, in which each of the plurality of communication controllers includes an error ratio measurement instrument configured to measure an error ratio of the network, based on a bit error of data that is received over the network, and in which the control device is configured to execute the operation control by switching the operation state of the elevator in accordance with the error ratio measured by the error ratio measurement instrument that is included in the first communication controller.

19 Claims, 12 Drawing Sheets

(51) Int. Cl.
*B66B 1/34* (2006.01)
*B66B 5/00* (2006.01)

(52) U.S. Cl.
CPC ..... *B66B 1/3453* (2013.01); *B66B 1/3461* (2013.01); *B66B 5/00* (2013.01); *B66B 5/0018* (2013.01); *B66B 5/0031* (2013.01); *B66B 2201/00* (2013.01)

(58) Field of Classification Search
CPC .. B66B 1/3461; B66B 5/0031; B66B 2201/00
USPC ..... 187/247, 289, 293, 313, 316, 391, 393; 709/224; 340/12.4, 12.52; 370/216, 221, 370/222, 225, 229, 237; 710/100, 105, 710/107
See application file for complete search history.

(56) References Cited

U.S. PATENT DOCUMENTS

| | | | | |
|---|---|---|---|---|
| 6,349,795 | B1 * | 2/2002 | Tatsumi | B66B 1/34 187/247 |
| 6,856,802 | B1 | 2/2005 | Kinnunen et al. | |
| 8,230,977 | B2 * | 7/2012 | Thumm | B66B 1/34 187/247 |
| 8,413,765 | B2 * | 4/2013 | Stratmann | B66B 5/0031 187/247 |
| 8,959,405 | B2 * | 2/2015 | Ikawa | B66B 1/34 714/704 |
| 9,367,416 | B2 * | 6/2016 | Hovi | B66B 5/0031 |
| 9,371,210 | B2 * | 6/2016 | Parillo | B66B 5/0018 |
| 9,452,909 | B2 * | 9/2016 | Taylor | B66B 1/3453 |
| 9,740,655 | B2 * | 8/2017 | Hartwich | H04L 1/0083 |
| 10,099,893 | B2 * | 10/2018 | Dugan | B66B 1/3453 |
| 2008/0091278 | A1 * | 4/2008 | Reynolds | B66B 1/34 700/3 |
| 2019/0177116 | A1 * | 6/2019 | Muncy | B66B 1/3453 |

FOREIGN PATENT DOCUMENTS

| | | | |
|---|---|---|---|
| JP | 9-121206 | A | 5/1997 |
| JP | 2002-538061 | A | 11/2002 |
| JP | 2002-540747 | A | 11/2002 |
| JP | 2004-48474 | A | 2/2004 |
| JP | 2004-320104 | A | 11/2004 |
| JP | 2013-180857 | A | 9/2013 |
| KR | 10-2009-0055031 | | 6/2009 |

OTHER PUBLICATIONS

Notification of Reason for Refusal dated Feb. 19, 2019 in Korean Application No. 10-2018-7001200.

* cited by examiner

ELEVATOR SAFETY SYSTEM

TECHNICAL FIELD

The present invention relates to an elevator safety system aimed to balance the securement of communication reliability and cost reduction.

BACKGROUND ART

In an elevator safety system of the related art, a switch, a sensor, and various other pieces of elevator equipment are individually connected to a control panel. The quantity of wires is consequently large.

This is addressed in the related art that connects equipment related to safety control out of various pieces of elevator equipment to a bus node. The bus node is connected to a safety controller via a safety bus, and an error detection code is used to detect an error of a signal that is related to safety control (see Patent Literature 1, for example). The quantity of wires can be reduced by employing the related art disclosed in Patent Literature 1.

CITATION LIST

Patent Literature

[PTL 1] JP 2002-538061 A

SUMMARY OF INVENTION

Technical Problem

The related art, however, has the following problems.

The elevator safety system disclosed in Patent Literature 1 is not capable of detecting all signal errors by the error detection code. In addition, noise generated in communication varies depending on the environment of individual buildings in which an elevator is installed. The resultant problem is that satisfactory error detection is not executed in a noise environment that exceeds a set value of the error detection code.

The related art also has a problem in that the allotted data amount (a user data area) is limited as a result of designing an elevator safety system for a too severe noise environment, or a problem in that the excessive use of error detection codes increases the processing load.

The present invention has been made to solve the problems described above, and an object of the present invention is to provide an elevator safety system that is reduced in the quantity of wires and that is capable of ensuring safety irrespective of the environment of individual buildings.

Solution to Problem

According to one embodiment of the present invention, there is provided an elevator safety system including: a plurality of communication controllers connected to equipment of an elevator and configured to communicate, over a network, signals of a plurality of types including a safety control signal; a control device connected to a first communication controller, which is one of the plurality of communication controllers, and configured to execute operation control of the elevator, in which each of the plurality of communication controllers includes an error ratio measurement instrument configured to measure an error ratio of the network, based on a bit error of data that is received over the network, and in which the control device is configured to execute the operation control by switching the operation state of the elevator in accordance with the error ratio measured by the error ratio measurement instrument that is included in the first communication controller, before communication of the safety control signal is started and during communication of the safety control signal.

Advantageous Effects of Invention

According to the present invention, the configuration is included in which information is shared through network communication among the plurality of communication controllers, a network error ratio is measured, and the operation state of the elevator can be switched depending on the result of the error ratio measurement. It is consequently possible to provide the elevator safety system that is reduced in the quantity of wires and that is capable of ensuring safety irrespective of the environment of individual buildings.

DESCRIPTION OF EMBODIMENTS

Referring to the accompanying drawings, an elevator safety system according to each of preferred embodiments of the present invention is described below.

First Embodiment

Figure 1:
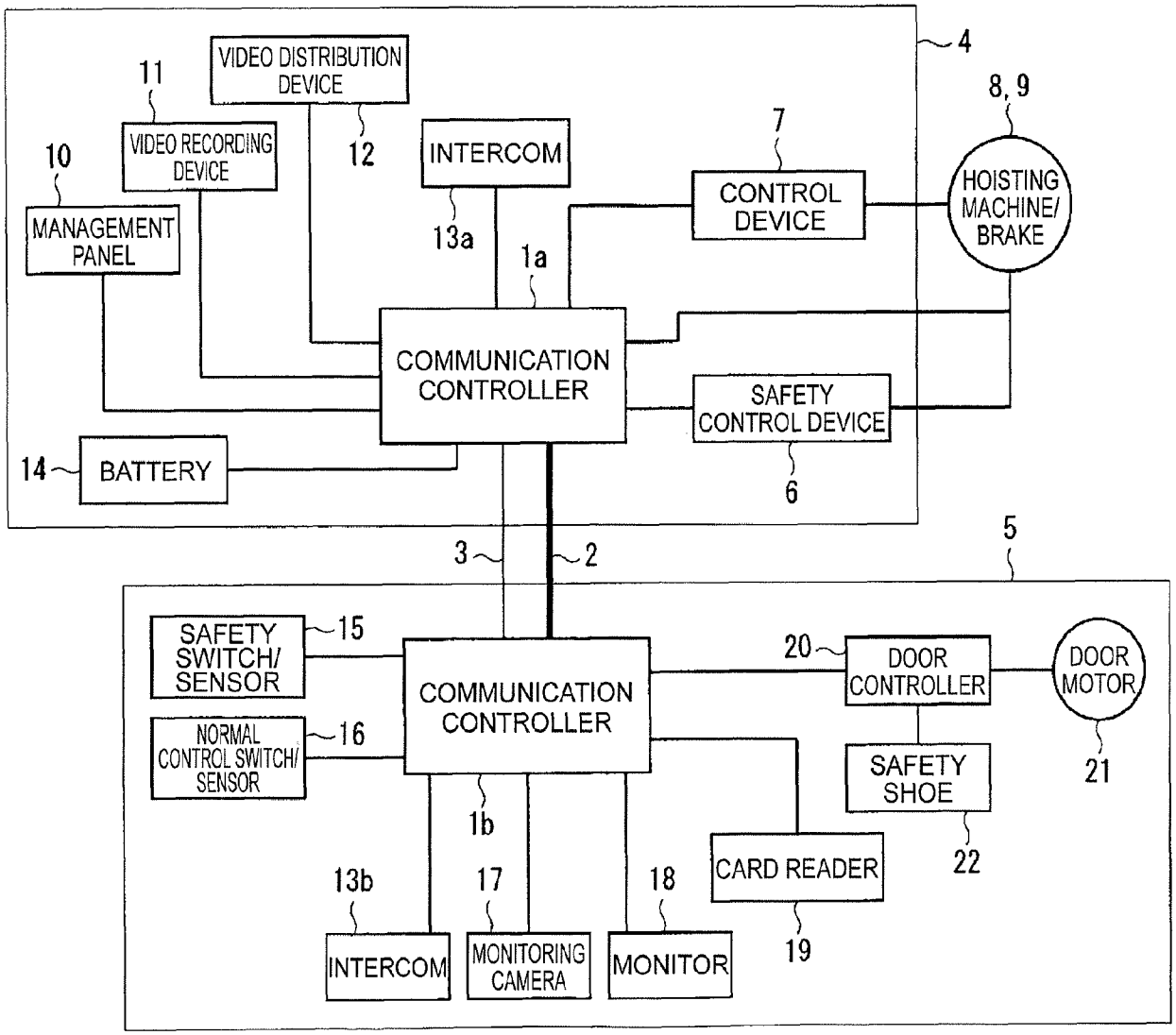
FIG. 1 is a block diagram for illustrating the configuration of an elevator safety system according to a first embodiment of the present invention.

FIG. 1 is a block diagram for illustrating the configuration of an elevator safety system according to a first embodiment of the present invention. The elevator safety system according to the first embodiment includes a car 5 and a control panel 4 configured to control the operation of the car 5.

The control panel 4 includes a communication controller 1*a*. The car 5, on the other hand, includes a communication controller 1*b*, which is connected to the communication controller 1*a* by a communication line 2 for network communication. An individual communication line 3 also connects the communication controller 1*a* and the communication controller 1*b* to each other.

While the first embodiment described here has two communication controllers 1*a* and 1*b*, the number of communication controllers 1 is not limited to 2, and may be 3 or more. The communication controller 1*b*, which is installed in the car 5 in the first embodiment described here, may be installed in places other than the car 5, specifically, a hoistway or a landing.

Various pieces of elevator equipment are installed in the car 5. Examples of the installed elevator equipment include a safety switch/sensor 15, a normal control switch/sensor 16, which is used for normal control, an intercom 13*b*, through which audio is input and output, a monitoring camera 17, a monitor 18, a card reader 19 of a serial communication device that provides a security function, a door controller 20, a door motor 21, and a safety shoe 22.

The safety switch/sensor 15 is configured to detect a state of the car 5 that is related safety control, and to output the result of the detection as a safety control signal. A floor landing sensor and a door switch, for example, correspond to the safety switch/sensor 15.

The normal control switch/sensor 16 is configured to detect a state of the car 5 that does not relate to safety control, and to output the result of the detection as a normal control signal. For example, a position switch configured to detect position plates (not shown), which are installed in the hoistway, corresponds to the normal control switch/sensor 16.

The door controller 20 is configured to control the opening/closing of a door (not shown) of the car 5, and also control the safety shoe 22, by driving the door motor 21.

The communication controller 1*a* in the control panel 4 has various pieces of elevator equipment connected thereto. Examples of the connected elevator equipment include a management panel 10, a video recording device 11, a video distribution device 12, and an intercom 13*a*.

The management panel 10 is configured to manage security by cooperating with the card reader 19. An example of this security management is demanding registration of a destination floor and approving the destination floor. The video recording device 11 is configured to record a video taken by the monitoring camera 17. The video distribution device 12 is configured to output a video to be displayed on the monitor 18. The intercom 13*a* is used to input and output audio, and has a talk function for talking on the intercom 13*a* and the intercom 13*b*, which is installed in the car 5.

A battery 14 is installed in the control panel 4 to serve as an auxiliary power source when a main power source is lost due to power outage or for other reasons. A control device 7 and a safety control device 6 are also installed in the control panel 4. The control device 7 and the safety control device 6 may be integrated into one control device.

The components installed in the control panel 4 are all connected to the communication controller 1*a* independently of one another. Of the pieces of elevator equipment in the control panel 4 that are illustrated in FIG. 1, each component except the control device 7 may be provided outside of the control panel 4, and may be provided in a machine room or a building manager room. The components provided in the machine room or the building manager room are connected to the communication controller 1*a* in the control panel 4.

The safety control device 6 and the control device 7 are connected to a hoisting machine 8 and a brake 9. The safety control device 6 and the control device 7 control the movement of the car 5 by driving the hoisting machine 8 and the brake 9. The control device 7 is configured to control the car 5 in a normal state based on information that is received from the communication controller 1*a* about various pieces of elevator equipment.

The safety control device 6, on the other hand, is configured to perform control related to the safety of the car 5 based on information that is received from the communication controller 1*a* about various pieces of elevator equipment. Examples of the control that is related to the safety of the car 5 and performed by the safety control device 6 include excessive-speed monitoring and preventing the car 5 from unintended movement with the door open. When determining that the car 5 is in an abnormal state, the safety control device 6 cuts off power to at least one of the hoisting machine 8 and the brake 9 in order to bring the car 5 to a stop at the nearest floor, or to an emergency stop.

Figure 2:
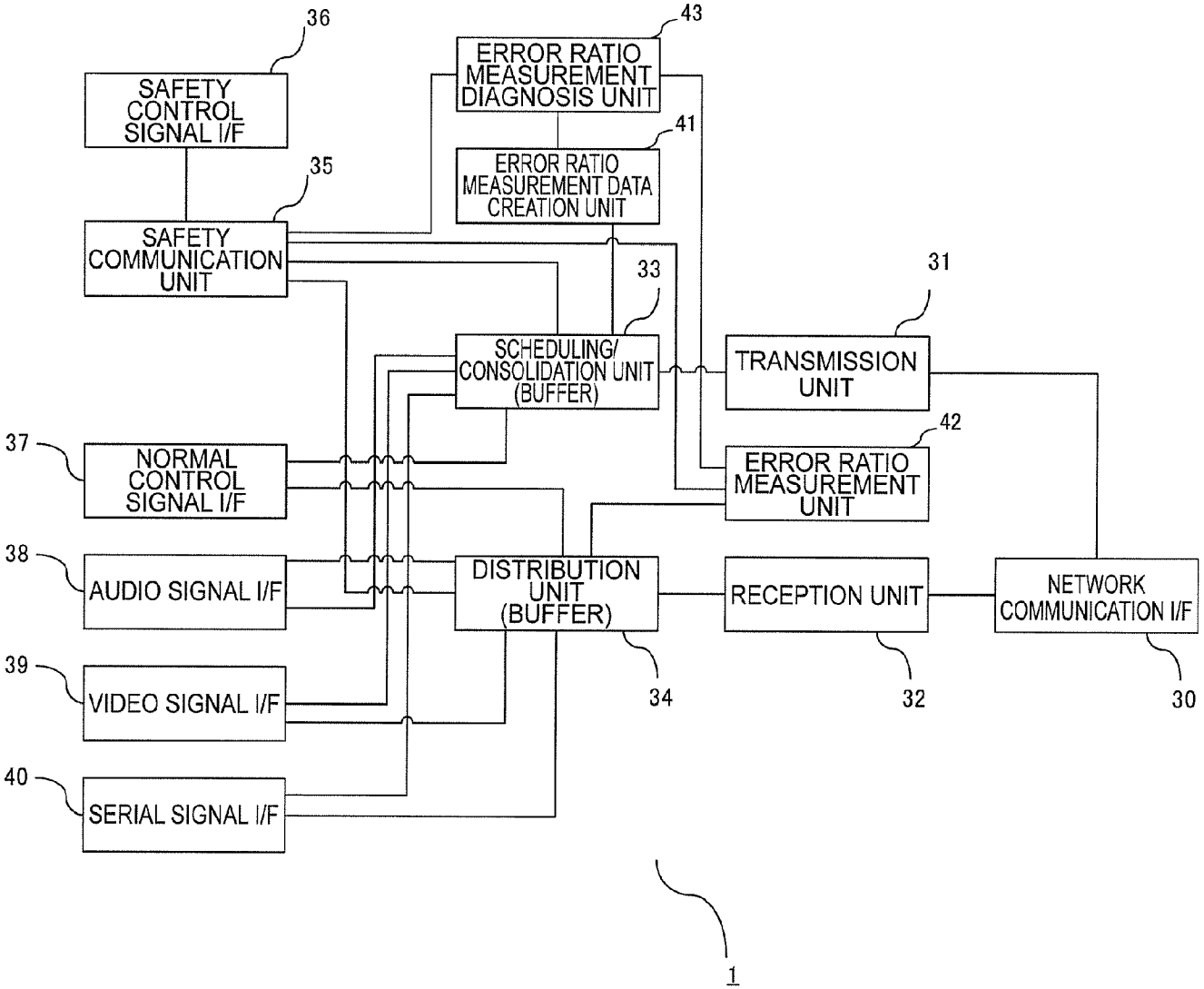
FIG. 2 is a block diagram for illustrating the internal configuration of each communication controller in the first embodiment of the present invention.

FIG. 2 is a block diagram for illustrating the internal configuration of each communication controller 1*a* in the first embodiment of the present invention. The configuration of the communication controller 1*b* is the same as the configuration illustrated in FIG. 2.

The communication controller 1*a* includes, as interfaces that connect the communication controller 1*a* to various pieces of elevator equipment and others, a network communication I/F 30, a safety control signal I/F 36, a normal control signal I/F 37, an audio signal I/F 38, a video signal I/F 39, and a serial signal I/F 40.

The interfaces are each configured to perform digital-to-analog conversion on a signal from the communication controller 1*a* to a relevant piece of elevator equipment, and to perform analog-to-digital conversion on a signal from the relevant piece of elevator equipment to the communication controller 1*a*. Each interface is also configured to perform encoding, decoding, and protocol conversion, for example.

The communication controller 1*a* includes a transmission unit 31, a reception unit 32, a scheduling/consolidation unit 33, a distribution unit 34, and a safety communication unit 35. The safety communication unit 35 is configured to attach, at a transmission stage, error detection information to a safety control signal received from the safety control signal I/F 36, and to perform error detection based on error detection information at a reception stage.

The scheduling/consolidation unit 33 is configured to determine the transmission schedule of each signal. The transmission unit 31 is configured to transmit a signal from the network communication I/F 30 to another communication controller in accordance with a transmission schedule determined by the scheduling/consolidation unit 33.

The reception unit 32 is configured to receive a signal from another communication controller via the network communication I/F 30. The distribution unit 34 is configured to distribute a signal that is received by the reception unit 32 to one of the interfaces except the safety control signal I/F 36, specifically, one of the interfaces 37 to 40, or to the safety communication unit 35.

The communication controller 1*a* further includes an error ratio measurement data creation unit 41, an error ratio measurement unit 42, and an error ratio measurement diagnosis unit 43. The error ratio measurement data creation unit 41 is configured to attach data for error ratio measurement to transmission data. The error ratio measurement unit 42 is configured to measure the error ratio of a network by checking error ratio measurement data that is included in reception data. The error ratio measurement diagnosis unit 43 is configured to check whether or not the error ratio measurement unit 42 is functioning appropriately by intentionally changing error ratio measurement data.

Figure 3:
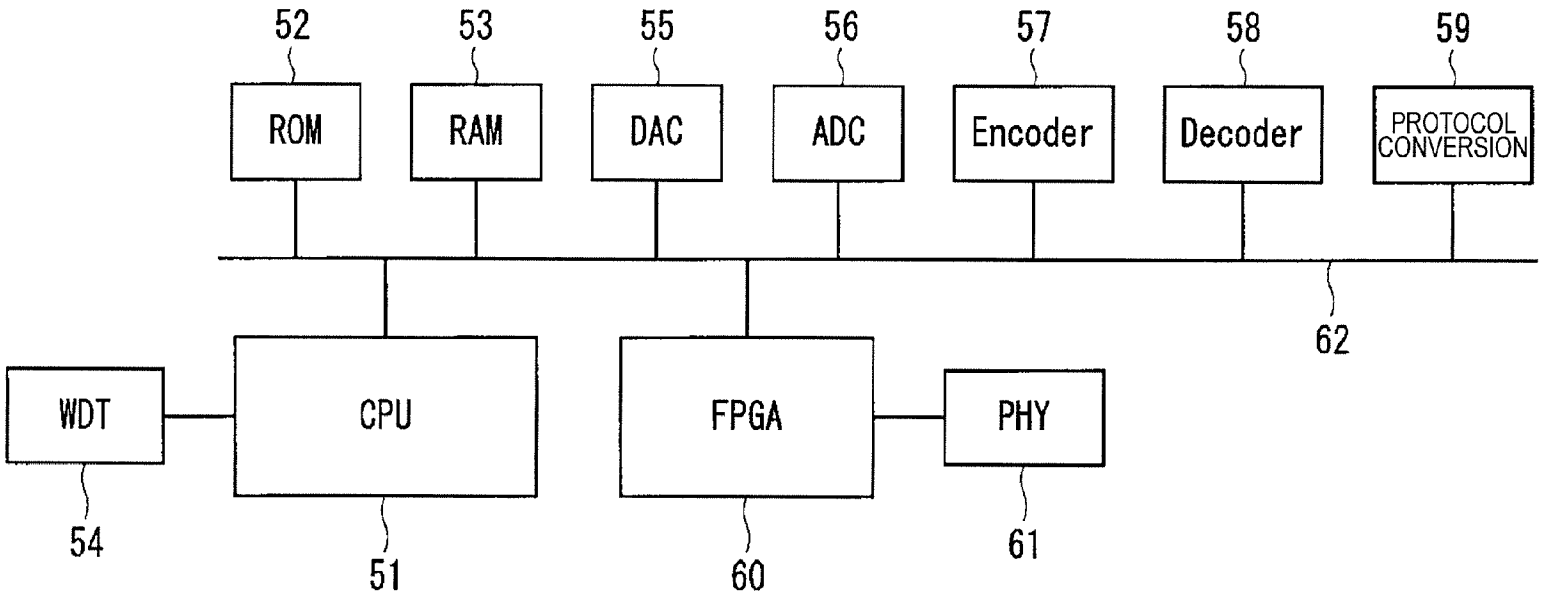
FIG. 3 is a diagram for illustrating the hardware configuration of each communication controller in the first embodiment of the present invention.

FIG. 3 is a diagram for illustrating the hardware configuration of each communication controller 1*a* in the first embodiment of the present invention. The hardware configuration of the communication controller 1*b* is the same as the configuration illustrated in FIG. 3.

The safety communication unit 35 is built from a central processing unit (CPU) 51, a read only memory (ROM) 52, a random access memory (RAM) 53, and a watchdog timer (WDT) 54.

The various interfaces are built from a digital-to-analog converter (DAC) 55, an analog-to-digital converter (ADC) 56, an encoder 57, a decoder 58, and a protocol conversion chip 59. The network communication I/F 30 is built from a physical layer (PHY) chip 61.

The transmission unit 31, the reception unit 32, the distribution unit 34, and the scheduling/consolidation unit 33 are built from a field-programmable gate array (FPGA) 60. A CPU, an application-specific integrated circuit (ASIC), or a complex programmable logic device (CPLD) may be used instead of the FPGA 60.

The error ratio measurement data creation unit 41, the error ratio measurement unit 42, and the error ratio measurement diagnosis unit 43 are built from the CPU or FPGA described above.

The DAC 55, the ADC 56, the encoder 57, the decoder 58, and the protocol conversion chip 59 may be included in the FPGA 60. The parts are connected to one another through a bus 62 and a connection line to exchange various types of data and signals.

Figure 4:
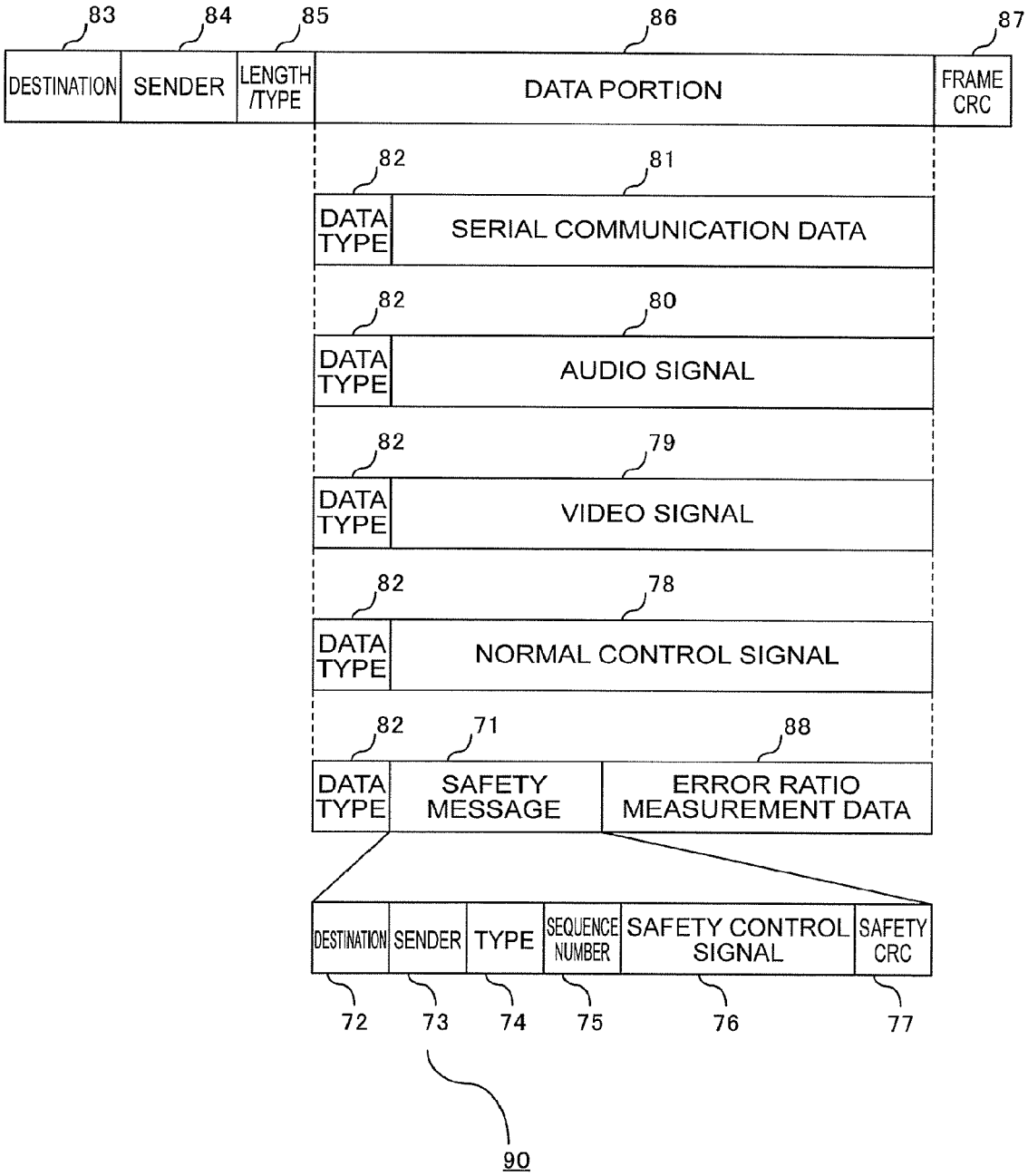
FIG. 4 is a diagram for illustrating the frame configuration of a message that is communicated between the communication controllers in the first embodiment of the present invention.

The method of communication error detection that is executed in the elevator safety system according to the first embodiment is described next. FIG. 4 is a diagram for illustrating the frame configuration of a message that is communicated between the communication controllers 1*a* and 1*b* in the first embodiment of the present invention. The message includes a destination 83, a sender 84, a length/type 85, a data portion 86, and a frame cyclic redundancy check (CRC) 87.

The data portion 86 stores a data type 82 and the main body of data, for example, serial communication data 81, an audio signal 80, a video signal 79, or a normal control signal 78. The data type 82 may be substituted with the length/type 85.

In the case of a message in which a safety control signal is transmitted, a safety message 71 is stored in the data portion 86. The safety message 71 contains a destination 72, a sender 73, a type 74, a sequence number 75, a safety control signal 76, and a safety CRC 77.

Error ratio measurement data 88 is transmitted in an empty area of a message that contains the safety message 71. Alternatively, the error ratio measurement data 88 and the safety message 71 may be transmitted in separate messages.

Figure 5:
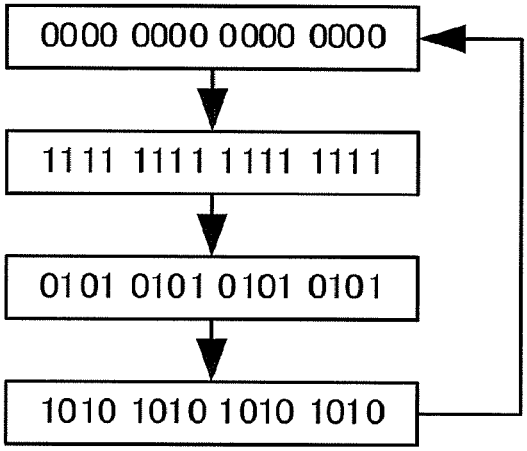
FIG. 5 is a diagram for illustrating a specific example of error ratio measurement data in the first embodiment of the present invention.

FIG. 5 is a diagram for illustrating a specific example of the error ratio measurement data 88 in the first embodiment of the present invention. As illustrated in FIG. 5, the same error ratio measurement data 88 is used in the same messages that are transmitted in succession, and different error ratio measurement data 88 is used in a message that is transmitted next in the succession of messages. The messages transmitted in succession are described later.

The communication controller 1*a* and the communication controller 1*b* transmit and receive the error ratio measurement data 88 to and from each other to measure the error ratio when the operation of the elevator is started by powering on the elevator or otherwise, before starting safety communication.

A safety message uses a header to indicate that safety communication has not been started, or uses dummy data (all-zero data or similar data) instead of containing an actual safety control signal.

When the measured error ratio is less than a safety communication start determination value, the communication controller 1*a* and the communication controller 1*b* start safety communication. The communication controller 1*a* and the communication controller 1*b* may hold other types of communication than safety communication before safety communication is started.

The error ratio may rise out of proportion in one error observation when an error is not observed due to insufficient communication amount for error ratio measurement. Safety communication is therefore started after a communication amount sufficient for error ratio measurement is secured.

Figure 6:
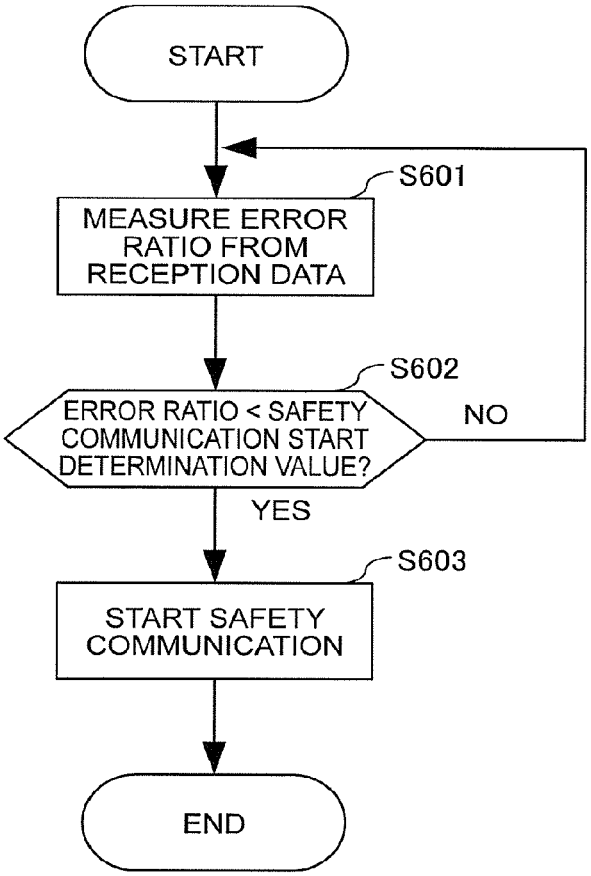
FIG. 6 is a flow chart for illustrating diagnosis processing of an error ratio measurement unit, which is executed in order to determine whether to start safety communication between a transmission-side communication controller and a reception-side communication controller in the first embodiment of the present invention.

FIG. 6 is a flow chart for illustrating diagnosis processing of the error ratio measurement unit 42, which is executed in order to determine whether to start safety communication between a transmission-side communication controller 1 and a reception-side communication controller 1 in the first embodiment of the present invention.

First, in Step S601, the error ratio measurement unit 42 in one of the communication controllers 1 measures the error ratio from reception data, and transmits the result of the measurement to the safety control device 6. A specific method of measuring the error ratio is described later with reference to FIG. 9.

Next, in Step S602, the safety control device 6 determines whether or not the error ratio is less than the safety communication start determination value set in advance. When the error ratio is determined as less than the safety communication start determination value, the processing proceeds to Step S603. In Step S603, the safety control device 6 starts safety communication and, after safety communication begins, starts operation of the elevator.

When the error ratio is determined as equal to or more than the safety communication start determination value, on the other hand, the processing returns to Step S601 to repeat from the error ratio measurement by the error ratio measurement unit 42.

Figure 7:
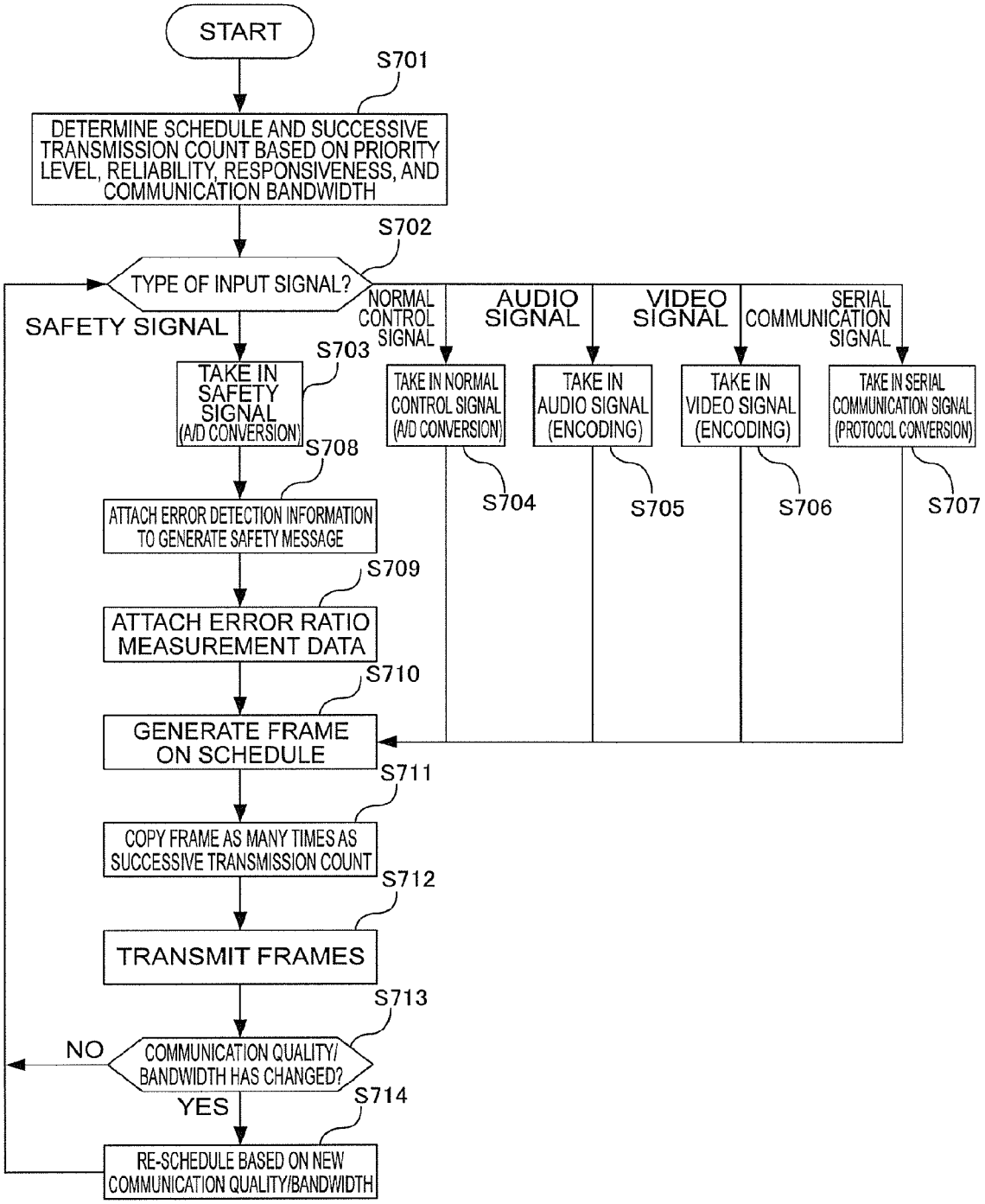
FIG. 7 is a flow chart for illustrating processing of transmitting from one communication controller to another communication controller in the first embodiment of the present invention.

FIG. 7 is a flow chart for illustrating processing of transmitting from the communication controller 1*b* to the communication controller 1*a* in the first embodiment of the present invention. The communication controller 1*b* receives signals from various types of elevator equipment of the car 5, and transmits the signals to the communication controller 1*a*.

In Step S701, the scheduling/consolidation unit 33 sets a priority level, reliability, and responsiveness to each of the various signals, and determines a transmission schedule and a successive transmission count for the signal based on the set priority level, reliability, and responsiveness. For example, the scheduling/consolidation unit 33 sets the highest priority level and a rather high successive transmission count to the safety message 71, and sets a rather low successive transmission count to the normal control signal 78.

The scheduling/consolidation unit 33 sets the audio signal 80 and the video signal 79, which are low in priority, so that the successive transmission count is zero, and so that the signals are thinned out when there is a shortage of bandwidth in the transmission path.

Pieces of elevator equipment that are installed in the car 5 are connected to the safety control signal I/F 36, the normal control signal I/F 37, the audio signal I/F 38, the video signal I/F 39, and the serial signal I/F 40 of the communication controller 1*b*. Signals from the pieces of elevator equipment are input to the interfaces.

In Step S702, the communication controller 1*b* determines a signal type for each of the input signals. The input signals are classified into a safety control signal type, a normal control signal type, an audio signal type, a video signal type, and a serial communication type.

A safety control signal is a signal that indicates the state of the safety switch/sensor 15, and is input to the safety control signal I/F 36 in Step S703. A normal control signal is a signal that indicates the state of the normal control switch/sensor 16, and is input to the normal control signal I/F 37 in Step S704.

An audio signal is a signal from the intercom 13*b*, and is input to the audio signal I/F 38 in Step S705. A video signal is a signal from the monitoring camera 17, and is input to the video signal I/F 39 in Step S706. A serial signal is a signal from the card reader 19, and is input to the serial signal I/F 40 in Step S707.

One of the following processing procedures that is determined by the type of an input signal is executed when the input signal is taken in through one of the interfaces. Specifically, A/D conversion is performed in Step S703 when the input signal is a safety control signal, or in Step S704 when the input signal is a normal control signal. Encoding is performed in Step S705 when the input signal is an audio signal, or in Step S706 when the input signal is a video signal. Protocol conversion is performed in Step S707 when the input signal is a serial communication signal.

After a safety control signal is taken in through the safety control signal I/F 36 in Step S703, the safety communication unit 35 attaches error detection information to the safety control signal in Step S708, to generate the safety message 71. The safety CRC 77 and the sequence number 75, for example, are attached as error detection information, and the safety message 71 as the one illustrated in FIG. 4 is generated.

The error ratio measurement data 88 is further attached to the safety message 71 in Step S709 by the error ratio measurement data creation unit 41.

The input signals 78 to 81, and the safety message 71 plus the error ratio measurement data 88, are sent to the scheduling/consolidation unit 33. In Step S710, the scheduling/consolidation unit 33 stores the input signals 78 to 81, and the safety message 71 plus the error ratio measurement data 88, in the respective data portions 86 based on the transmission schedules determined in Step S701.

The scheduling/consolidation unit 33 further attaches a header that is made up of the destination 83, the sender 84, and the length/type 85, and attaches the frame CRC 87 to generate a frame.

In Step S711, the scheduling/consolidation unit 33 copies the frame generated in Step S710 as many times as the successive transmission count determined in Step S701, thereby generating frames that contain messages to be transmitted in succession, and sends the frames to the transmission unit 31. In Step S712, the transmission unit 31 transmits the frames generated by the scheduling/consolidation unit 33 to the network 2 via the network communication I/F 30.

When a common schedule and a common successive transmission count are shared by a plurality of signals, the scheduling/consolidation unit 33 may transmit the plurality of signals en masse in one message. The scheduling/consolidation unit 33 can transmit a plurality of signals en masse in one message also when only the schedule is common to the plurality of signals, by adopting the highest successive transmission count among the plurality of signals.

In Step S713, the reception unit 32 conducts a check with the use of the frame CRC 87 to monitor for a communication error (a CRC abnormality). Specifically, the reception unit 32 uses the number of times a communication error has occurred per unit time as a communication error frequency, and determines the quality of a communication path from the communication error frequency.

How the communication quality and the communication error frequency are related to each other is set in advance, and is held by the communication controllers 1. When there is a change in communication quality, the reception unit 32 notifies information about the communication quality to the scheduling/consolidation unit 33, and the processing proceeds to Step S714. When there is no change in communication quality, on the other hand, the processing returns to Step S702 to repeat the series of processing steps.

When the processing proceeds to Step S714, the scheduling/consolidation unit 33 notified by the reception unit 32 resets the schedule in accordance with the new communication quality. When the change is a drop in communication quality, for example, the scheduling/consolidation unit 33 resets the schedule by increasing the successive transmission count of a high priority signal, by reducing the successive transmission count of a low priority signal, or by thinning out a signal that is not required to have reliability.

When the change is an improvement in communication quality, on the other hand, the scheduling/consolidation unit 33 resets the schedule by reducing the successive transmission count of a high priority signal, by increasing the successive transmission count of a low priority signal, or by stopping thinning out the transmission of a signal that has been thinned out or less heavily thinning out the signal.

After the schedule is reset in Step S714, the processing returns to Step S702 to repeat the series of processing steps based on the reset schedule.

Figure 8:
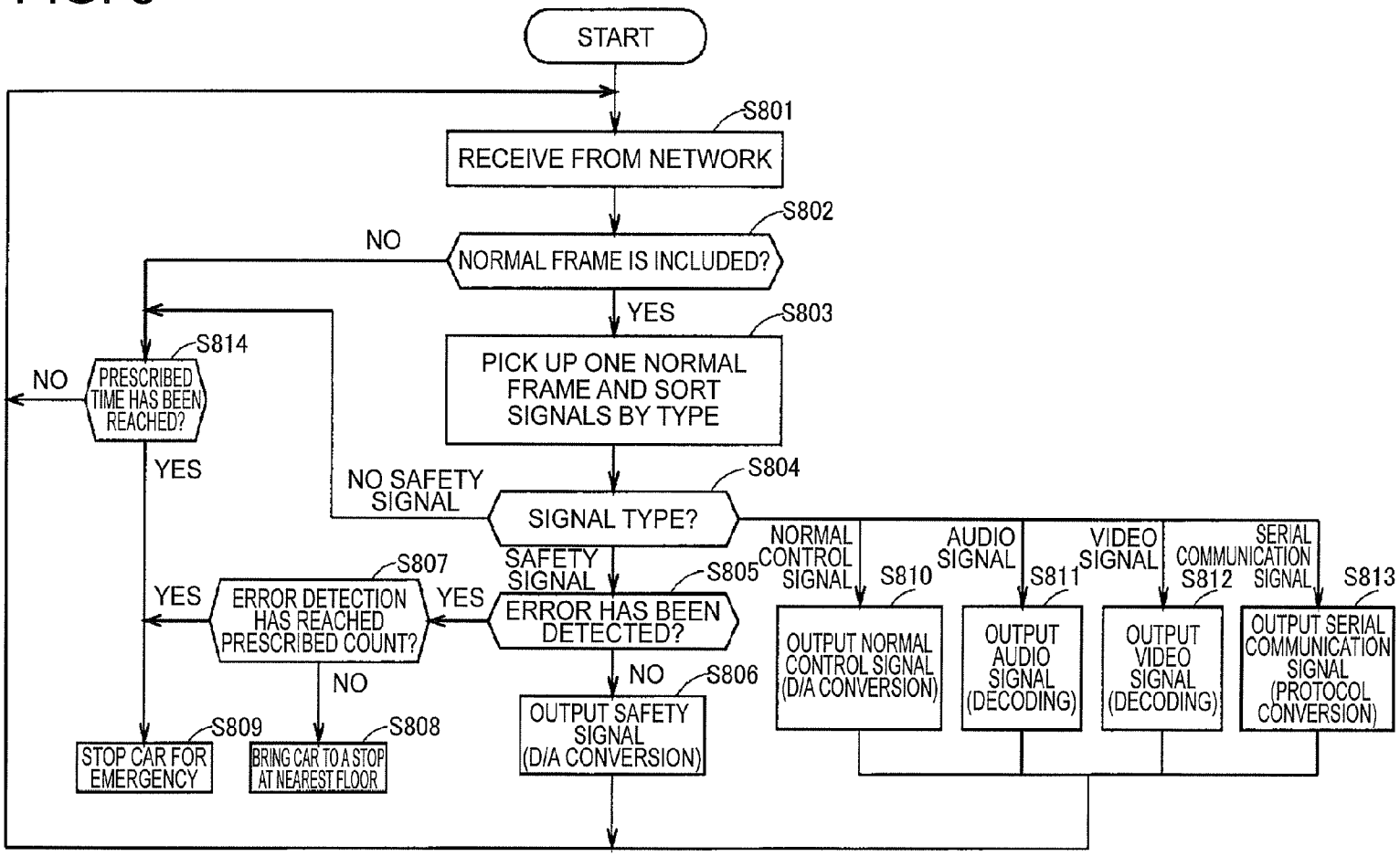
FIG. 8 is a flow chart related to a series of reception processing steps that is executed by one of the communication controllers in the first embodiment of the present invention.

Reception processing of the communication controller 1*a* is described next. FIG. 8 is a flow chart related to a series of reception processing steps that is executed by one of the communication controllers in the first embodiment of the present invention.

In Step S801, the reception unit 32 of the communication controller 1*a* receives messages from the network 2 via the network communication I/F 30. In Step S802, the distribution unit 34 conducts a check with the use of the frame CRC 87 to determine whether or not there is a frame that is normal among a plurality of the same messages transmitted in succession.

When the distribution unit 34 determines in Step S802 that a normal frame is included, the processing proceeds to Step S803. The processing proceeds to Step S814 when the distribution unit 34 determines that none of the frames is normal.

When the processing proceeds to Step S814, the safety communication unit 35 determines whether or not a prescribed time has been reached. When the safety communication unit 35 determines that the prescribed time has not been reached, the processing returns to Step S801 to repeat the series of processing steps. When the safety communication unit 35 determines that the prescribed time has been reached, on the other hand, the processing proceeds to Step S809. In Step S809, the car 5 is stopped for emergency.

In Step S809, the communication controller 1*a* notifies the safety control device 6 that the car 5 is to be stopped for emergency, and the safety control device 6 can stop the car 5 immediately by cutting power to the hoisting machine 8 or the brake 9. Alternatively, the communication controller 1*a* itself may stop the car 5 by cutting power to the hoisting machine 8 or the brake 9.

After the emergency stop, the car 5 maintains the stopped state until maintenance work is done by a maintenance worker.

When it is determined in Step S802 that a normal frame is included and the processing proceeds to Step S803, on the other hand, the distribution unit 34 picks up one of the frames determined as normal, and distributes data for each signal type separately.

In Step S804, the distribution unit 34 next determines the type of an input signal. When the received signal does not include a safety control signal, the processing proceeds to Step S814, and a notification to that effect is sent to the safety communication unit 35. In Step S814, the safety communication unit 35 determines whether or not the prescribed time has been reached. When it is determined that the prescribed time has been reached, the processing proceeds to Step S809. In Step S809, the car 5 is stopped for emergency.

When it is determined that the prescribed time has not been reached, on the other hand, the processing returns to Step S810 to repeat the series of processing steps. Processing of bringing the car 5 to a stop at the nearest floor may instead be executed as in Step S808, which is described later, when it is determined that the prescribed time has not been reached.

To bring the car 5 to a stop at the nearest floor, the safety communication unit 35 notifies the control device 7 that the car 5 is to be brought to a stop at the nearest floor. When receiving the notification, the control device 7 brings the car 5 to a stop at the nearest floor.

The system is then restarted in an attempt to recover the network 2 and to resume the operation of car 5. However, the car 5 is kept stopped and waits for recovery by a maintenance worker when the network 2 and the car 5 fail to recover after the system is restarted for a given number of times or more.

The description returns to Step S804. When the signal received as an input signal is a safety control signal, the distribution unit 34 transmits the safety message 71 to the safety communication unit 35. The safety communication unit 35 executes error detection with the use of error detection information in the safety message 71. Specifically, the safety communication unit 35 conducts a check that uses the safety CRC 77 and checks the sequence number 75.

When no error is detected by the safety communication unit 35 in Step S805, the processing proceeds to Step S806. When there is an error detected by the safety communication unit 35 in Step S805, the processing proceeds to Step S807.

In Step S806, the safety communication unit 35 outputs the received safety control signal to the safety control device 6 and the control device 7 via the safety control signal I/F 36. The processing then returns to Step S801 to receive the next message.

When the processing proceeds to Step S807, on the other hand, the safety communication unit 35 determines whether or not the error detection count has reached a prescribed count. When it is determined that the error detection count has not reached the prescribed count, the processing proceeds to Step S808. In Step S808, the control device 7 notified by the safety communication unit 35 brings the car 5 to a stop at the nearest floor. When it is determined that the error detection count has reached the prescribed count, on the other hand, the processing proceeds to Step S809 to execute the processing of stopping the car 5 for emergency as described above.

Signals other than the safety control signal are output in Steps S810 to S813 to relevant pieces of elevator equipment through the interfaces 37 to 40 of the respective signals.

The normal control signal, for example, is converted by D/A conversion at the normal control signal I/F 37 in Step S810, and is then output to the control device 7. The audio signal is decoded at the audio signal I/F 38 in Step S811, and is then output to the intercom 13*a* or the like.

The video signal is decoded at the video signal I/F 39 in Step S812, and is then output to the video recording device 11 or the like. The serial signal is converted by protocol conversion at the serial signal I/F 40 in Step S813, and is then output to the management panel 10 or other pieces of elevator equipment.

The description given next is about processing that is executed by the error ratio measurement unit 42 to measure the error ratio of a network from received error ratio measurement data. The outline of the processing is described first.

The error ratio measurement unit 42 determines whether or not the frame CRC 87 of the received safety message matches. When determining that the frame CRC 87 matches, the error ratio measurement unit 42 adds the length of areas in this message minus the CRC area to the count on a received bit counter.

Instead of incorporating the function of processing CRC determination processing that uses the frame CRC 87 into the error ratio measurement unit 42, the error ratio measurement unit 42 may be configured so as to receive only the result of CRC determination of each message from another function block, for example, the reception unit 32.

When determining that the frame CRC 87 does not match, on the other hand, the error ratio measurement unit 42 determines for each bit of this message whether the bit is normal or abnormal. A safety message always has successively transmitted messages that are transmitted immediately before and after the safety message of interest, and whether the bit is normal or abnormal is determined by comparison to one of the preceding and following successively transmitted messages that is normal (a message determined as normal by CRC determination).

The CRC area is excluded from the determination. Messages of the safety control signal 76 to be transmitted in succession are transmitted in succession without fail by withholding the transmission of other types of messages until the successive transmission is completed.

In a message of the safety control signal 76, the length/type 85 or the data type 82 includes information about the number of times successive transmission is to be executed and information about the place of this message in the order of successive transmission. The error ratio measurement unit 42 identifies from the included information the span of messages that are messages of the same safety control signal 76.

More specifically, when a received message includes information that says "the successive transmission count is 6, and a number assigned to this message out of six successively transmitted messages is 3", for example, the error ratio measurement unit 42 executes the following processing. Specifically, the error ratio measurement unit 42 infers that this message, two messages that immediately precede this message, and three messages that immediately follow this message, six messages in total, are the same message. The error ratio measurement unit 42 also assumes that an abnormal message received in the span of six messages is one of the successively transmitted messages.

The error ratio measurement unit 42 adds the number of bits determined as abnormal to the count on a received abnormal bit counter, and adds the size of all areas of a message that contains an abnormal bit, except the CRC area, to the count on the received bit counter.

Figure 9:
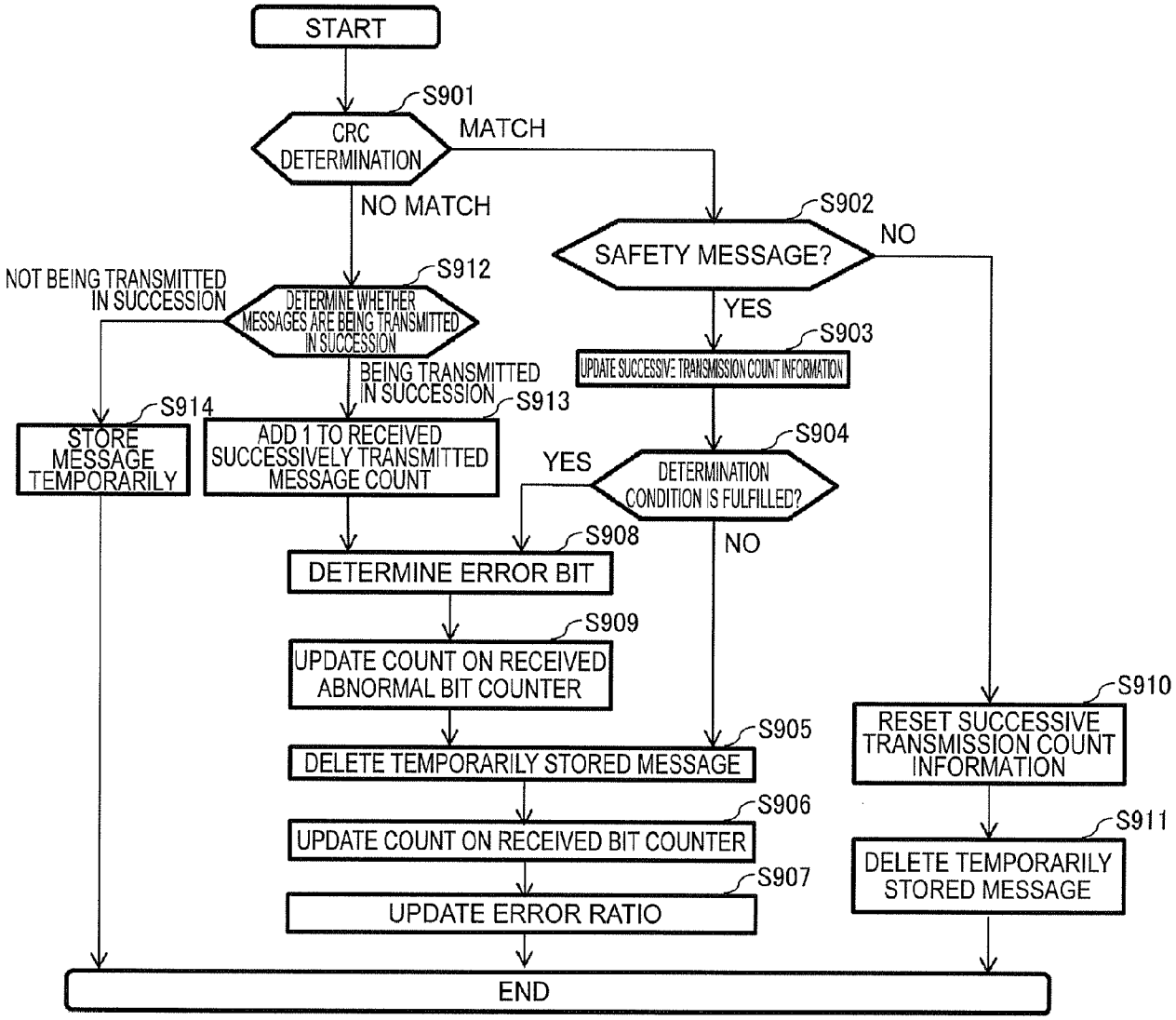
FIG. 9 is a flow chart for illustrating a series of processing steps that is executed by the error ratio measurement unit in the first embodiment of the present invention.

Details of the series of processing steps executed by the error ratio measurement unit 42 are described next with reference to a flow chart. FIG. 9 is a flow chart for illustrating a series of processing steps that is executed by the error ratio measurement unit 42 in the first embodiment of the present invention.

First, in Step S901, the error ratio measurement unit 42 executes CRC determination for a received message. The processing proceeds to Step S902 when the CRC is determined as a match, and to Step S912 when it is determined that the CRC does not match.

When the CRC is determined as a match and the processing proceeds to Step S902, the error ratio measurement unit 42 determines whether or not the received message is a safety message. The processing proceeds to Step S903 when the received message is a safety message, and to Step S910 when the received message is not a safety message.

When the received message is a safety message and the processing proceeds to Step S903, the error ratio measurement unit 42 updates successive transmission count information. The successive transmission count information includes the total successive transmission count of the message and a number assigned to the message. After the update processing in Step S903, the error ratio measurement unit 42 executes "Determination 1" described below in Step S904, as determination processing that is based on the successive transmission count information and whether or not there is a temporarily stored message.

Determination 1

A case in which one of the following cases fits and there is a temporarily stored message:

a case in which the same safety message as the last time is received and the successive transmission numbers of the safety messages are not consecutive numbers; or a case in which a new safety message is received and has a successive transmission number that is not 1.

When the condition of "Determination 1" is fulfilled in Step S904, the error ratio measurement unit 42 determines that the error ratio measurement unit 42 has failed to receive a message that is normal in its correct order, and the processing proceeds to Step S908. When the condition of "Determination 1" is not fulfilled in Step S904, on the other hand, the error ratio measurement unit 42 determines that a message that is normal has been received in its correct order, and the processing proceeds to Step S905.

In Step S908, the error ratio measurement unit 42 executes error bit determination. In Step S909, the error ratio measurement unit 42 updates the count on the received abnormal bit counter, and the processing proceeds to Step S905.

When the condition of "Determination 1" is not fulfilled and the processing proceeds to Step S905, or when the processing proceeds to Step S905 after Step S909, the error ratio measurement unit 42 deletes the temporarily stored message. The error ratio measurement unit 42 updates the count on the received bit counter in Step S906, recalculates the error ratio in Step S907, and then ends the series of processing steps.

When the processing proceeds to Step S910 as a result of determining the CRC as a match and determining in Step S902 that the received message is not a safety message, the error ratio measurement unit 42 regards that successive transmission has been completed because messages of a safety control signal are always transmitted in succession, and resets the successive transmission count information. In Step S911, the error ratio measurement unit 42 then deletes the temporarily stored message, and ends the series of processing steps.

When the processing proceeds to Step S912 as a result of determining in Step S901 that the CRC is not a match, the error ratio measurement unit 42 determines from the successive transmission count information that is held whether or not safety messages are being transmitted in succession. The processing proceeds to Step S913 when it is determined that safety messages are being transmitted in succession, and to Step S914 when it is determined that successive transmission is not being executed.

When it is determined that successive transmission is being executed and the processing proceeds to Step S913, the error ratio measurement unit 42 assumes that the message of which the CRC is not a match is one of the successively transmitted messages, and adds 1 to the number of successively transmitted messages that have been received. The error ratio measurement unit 42 then executes the already described Steps S908, S909, S905, S906, and S907 in the order stated, and ends the series of processing steps.

When it is determined that successive transmission of safety messages is not being executed and the processing proceeds to Step S914, the error ratio measurement unit 42 temporarily stores the received message, and ends the series of processing steps.

When the flow chart of FIG. 9 is followed and none of successively transmitted messages is a normal message, the reception of a safety control signal itself cannot be recognized and error determination is therefore not executed. In this case, however, the safety communication unit 35 can recognize an error in Step S802 of FIG. 8 from the fact that a safety message has not been received.

Then the error ratio measurement unit 42 can obtain error information from the safety communication unit 35, and add to the error count. This ensures that an error is reflected in the result of error ratio measurement also when all of successively transmitted messages fail to be received.

The error ratio recalculation processing in Step S907 of FIG. 9 is described next. The error ratio measurement unit 42 can calculate the error ratio by an expression given below, from the value of the received abnormal bit counter that has been updated in Step S909 and from the value of the received bit counter that has been updated in Step S906.

Error ratio=received abnormal bit counter value/received bit counter value

The description given on the series of processing steps with reference to FIG. 9 deals with a case in which the error ratio is measured by using the safety message 71. Instead, an error ratio measurement message dedicated to error ratio measurement may be used as the error ratio measurement data 88.

Processing in this case replaces the safety message in the description of FIG. 9 with the error ratio measurement message. Alternatively, a configuration in which error ratio measurement that uses the safety message is mixed with error ratio measurement that uses the error ratio measurement message may be employed.

Figure 10:
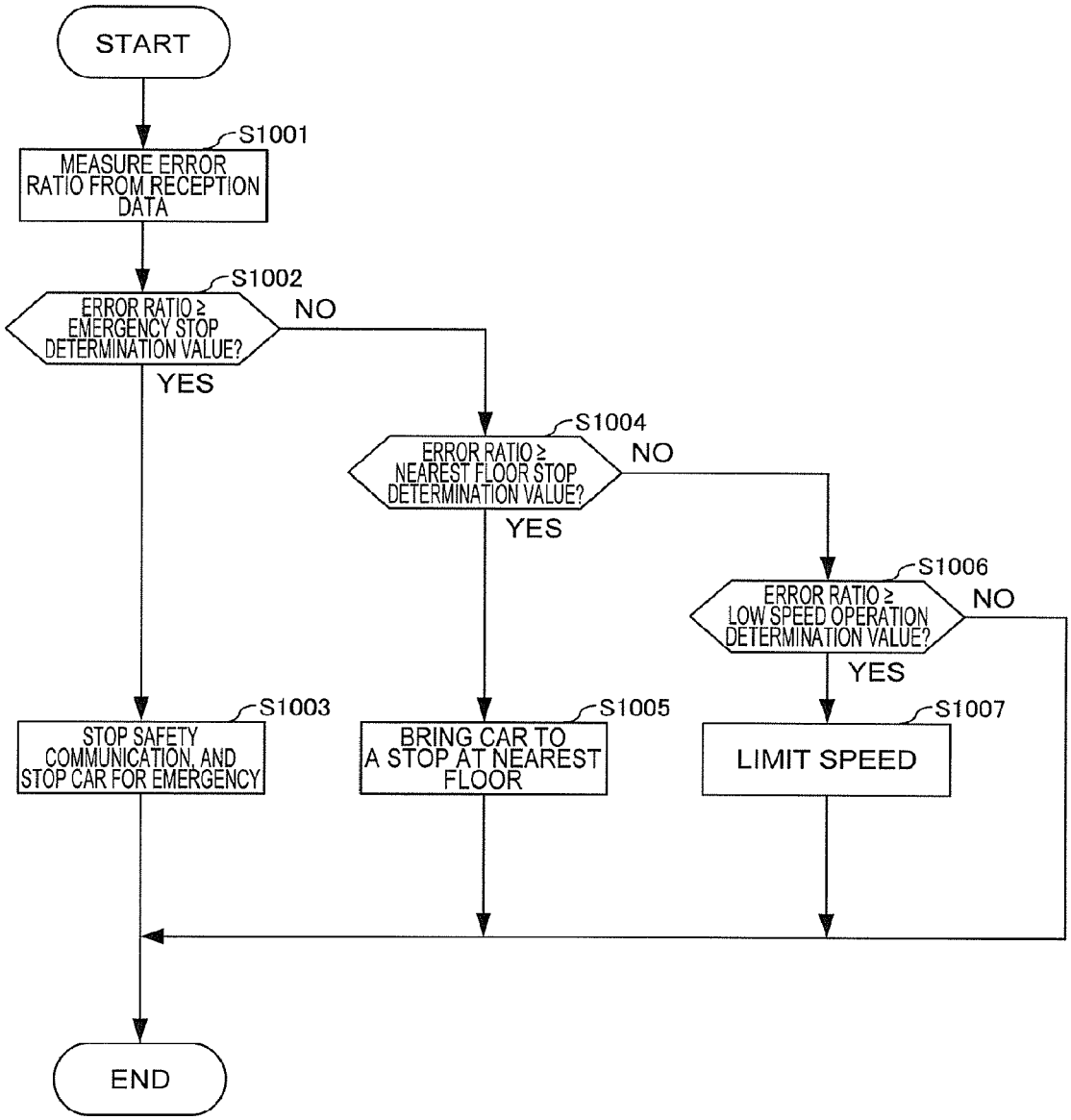
FIG. 10 is a flow chart for illustrating a series of processing steps of control in accordance with an error ratio and that is executed by a safety control device in the first embodiment of the present invention.

Control executed after error ratio calculation according to the result of the calculation is described next. FIG. 10 is a flow chart for illustrating a series of processing steps of control in accordance with the error ratio and that is executed by the safety control device 6 that has received a command from one of the communication controllers 1 in the first embodiment of the present invention.

First, in Step S1001, the error ratio measurement unit 42 in the communication controller 1 measures the error ratio from reception data by executing the processing of FIG. 9, and transmits the result of the measurement to the safety control device 6.

Next, in Step S1002, the safety control device 6 determines whether or not the error ratio is equal to or more than an emergency stop determination value set in advance. When the error ratio is determined as equal to or more than the emergency stop determination value, the processing proceeds to Step S1003. In Step S1003, the safety control device 6 determines that there are frequent noises, stops safety communication, and stops the car 5 for emergency.

When the error ratio is determined as less than the emergency stop determination value, on the other hand, the processing proceeds to Step S1004. In Step S1004, the safety control device 6 determines whether or not the error ratio is equal to or more than a nearest floor stop determination value, which is set in advance as a value smaller than the emergency stop determination value. When the error ratio is determined as equal to or more than the nearest floor stop determination value, the processing proceeds to Step S1005. In Step S1005, the safety control device 6 regards the noises as temporary and brings the car 5 to a stop at the nearest floor. In this case, however, communication continues.

When the error ratio is determined as less than the nearest floor stop determination value, on the other hand, the safety control device 6 does not execute particular processing, the processing proceeds to Step S1006, and communication continues.

In Step S1006, the safety control device 6 determines whether or not the error ratio is equal to or more than a low speed running determination value, which is set in advance as a value smaller than the nearest floor stop determination value. When the error ratio is determined as equal to or more than the low speed running determination value, the processing proceeds to Step S1007. In Step S1007, the safety control device 6 notifies the control device 7 that the highest speed of the elevator is to be regulated, and the elevator is switched to low speed running.

When the error ratio is determined as less than the low speed running determination value, on the other hand, the safety control device 6 determines that the communication state is normal, normal operation is continued, and the series of processing steps is ended.

Although not illustrated in the flow chart of FIG. 10, the elevator can return to normal operation when the error ratio recovers to a value less than the low speed running determination value and the safety control device 6 notifies the control device 7 that the elevator is to return to normal operation.

The switching of operation modes (emergency stop, nearest floor stop, speed restriction, and normal operation) may be determined by the communication controller 1, and may be executed by notifying the result of the determination to the safety control device 6 and the control device 7.

Figure 11:
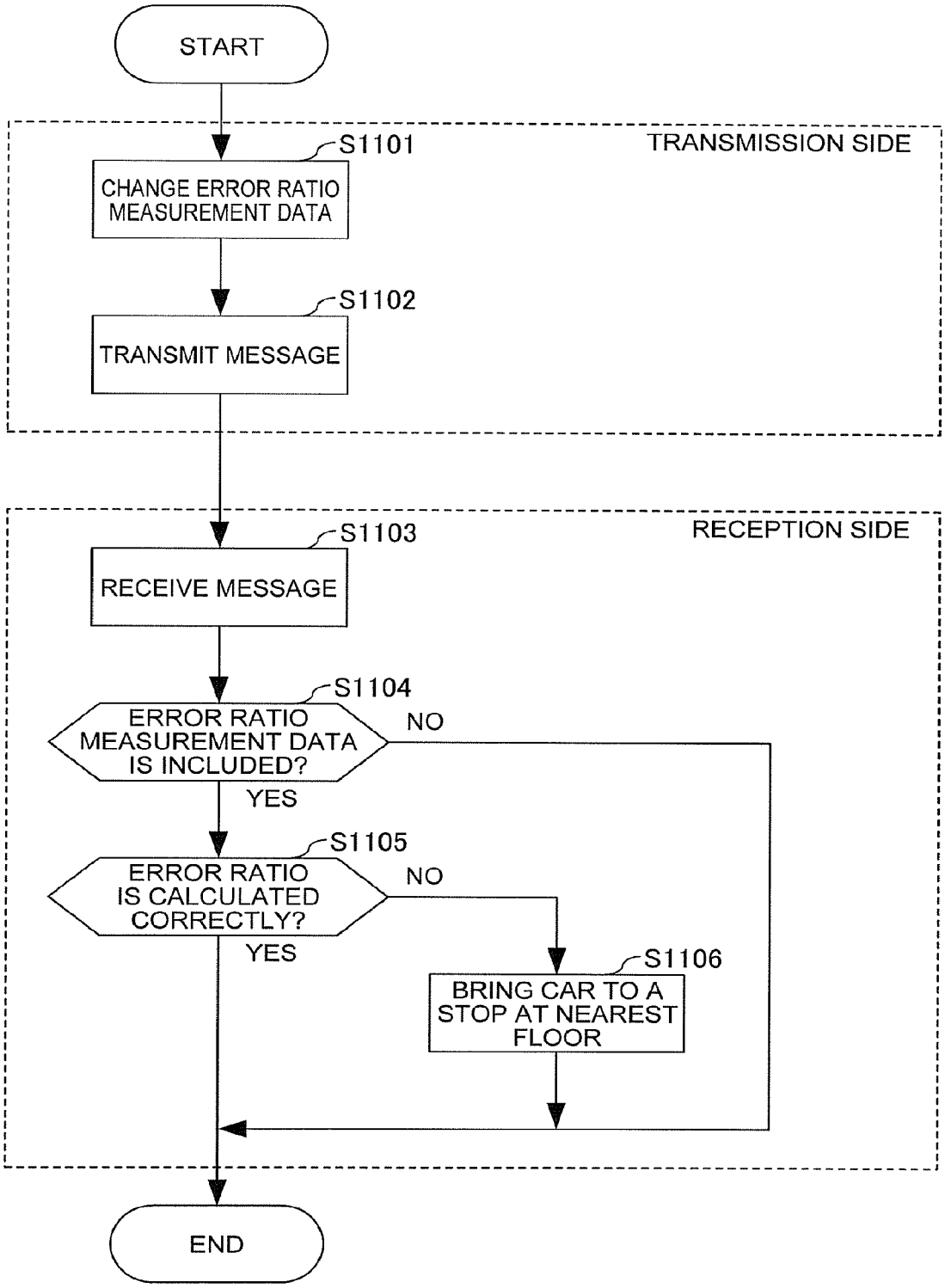
FIG. 11 is a flow chart for illustrating processing of diagnosing the error ratio measurement unit, which is executed between a transmission-side communication controller and a reception-side communication controller in the first embodiment of the present invention.

A function of diagnosing, at regular time intervals, whether or not the error ratio measurement unit 42 is normally functioning is described next. FIG. 11 is a flow chart for illustrating processing of diagnosing the error ratio measurement unit 42, which is executed between a transmission-side communication controller 1 and a reception-side communication controller 1 in the first embodiment of the present invention.

First, in Step S1101, the error ratio measurement diagnosis unit 43 in the transmission-side communication controller 1 changes error ratio measurement data that has been created by the error ratio measurement data creation unit 41. The error ratio measurement diagnosis unit 43 changes error ratio measurement data that has been created by the error ratio measurement data creation unit 41 by, for example, inverting a particular bit or replacing all bits with fixed data.

Information about the number of bits replaced by the error ratio measurement diagnosis unit 43 is stored in the area of the data type 82, in the area of the type 74 of the safety message 71, or in a similar area. In Step S1102, the transmission-side communication controller 1 transmits to the reception-side communication controller 1 a message that contains error ratio measurement data used to diagnose the error ratio measurement unit.

In Step S1103, the reception-side communication controller 1 receives the message transmitted from the transmission-side communication controller 1. In Step S1104, the reception-side communication controller 1 determines whether or not the received message contains the error ratio measurement data from the data type 82 or the like.

The processing proceeds to Step S1105 when the reception-side communication controller 1 determines that the error ratio measurement data is contained in the received message. When determining that the error ratio measurement data is not contained in the received data, on the other hand, the reception-side communication controller 1 ends the series of processing steps.

When the processing proceeds to Step S1105 as a result of determining that the received message contains the error ratio measurement data, the error ratio measurement diagnosis unit 43 in the reception-side communication controller 1 checks whether or not the result of error ratio calculation performed by the error ratio measurement unit 42 is an error ratio based on the number of replaced bits. Error ratios that are calculated in the diagnosis of the error ratio measurement unit 42 are excluded from normal error ratio monitoring.

The reception-side communication controller 1 ends the series of processing when the result of error ratio calculation performed by the error ratio measurement unit 42 is correct. When the result of error ratio calculation performed by the error ratio measurement unit 42 is incorrect, on the other hand, the processing proceeds to Step S1106.

In Step S1106, the reception-side communication controller 1 notifies the safety control device 6 that the result of error ratio calculation performed by the error ratio measurement unit 42 is incorrect. When receiving the notification, the safety control device 6 brings the car 5 to a stop at the nearest floor or the destination floor, and stops providing the service. The series of processing steps is then ended.

The transmission-side communication controller can also diagnose its own error ratio measurement unit 42 by looping back the message that contains the diagnosis data.

In addition to the diagnosis of the error ratio measurement unit 42, the elevator safety system according to the first embodiment is capable of the following self-diagnosis.

The safety communication unit 35 can have a self-diagnosis function such as a check of the CPU 51 by a self-test program, the monitoring of the execution time by the WDT 54, a read/write check of the RAM 53, a CRC check of the ROM 52, and the monitoring of an input/output signal by comparing input/output signals of dual systems or by reading back an output signal. The communication controllers 1 in the first embodiment can thus have reliability high enough to handle information related to safety control. The safety communication unit 35 may be given redundancy.

When a failure in the safety communication unit 35 is detected by the self-diagnosis function described above, the safety communication unit 35 notifies the failure to the safety control device 6. The safety control device 6 receives the notification and, when the failure in the safety communication unit 35 is temporarily garbled bits or a similarly minor failure, brings the car 5 to a stop at the nearest floor. The safety control device 6 stops the car 5 for emergency when the failure in the safety communication unit 35 is the sticking of an output signal to a particular value or a similarly serious failure.

The first embodiment describes a case in which information about elevator equipment that is installed in the car 5 is transmitted from the communication controller 1*b* to the communication controller 1*a* to be output to elevator equipment that is connected to the control panel 4. However, the method of the first embodiment is applicable also to a case in which information is transmitted from the communication controller 1*a* to the communication controller 1*b*.

When information is transmitted from the communication controller 1*a* to the communication controller 1*b* as in the case in which a control signal is transmitted from the control device 7 to the door controller 20, or the case in which a video signal is transmitted from the video distribution device 12 to the monitor 18, for example, processing in the communication controller 1*a* and processing in the communication controller 1*b* are switched.

In this case, a communication error or the communication error ratio, or an operation mode switching command can be notified to the communication controller 1*a* on the control panel 4 side from the communication controller 1*b* with the use of the network 2 or the individual communication line 3. This enables the safety control device 6 and the control device 7 to execute appropriate control in accordance with the content of the notification given via the network 2 or the individual communication line 3, such as continuing the operation of the car 5, limiting the speed of the car 5, bringing the car 5 to a stop at the nearest floor, or stopping the car 5 for emergency.

Alternatively, the communication controller 1*b* may instruct through the network 2 or the individual communication line 3 the safety control device 6 and the control device 7, which are connected to the communication controller 1*a*, to continue the operation of the car 5, to limit the speed of the car 5, to bring the car 5 to a stop at the nearest floor, or to a stop the car 5 for emergency.

The elevator safety system may employ a configuration in which a safety control device and a control device that are connected to the communication controller 1*b* are provided in the car 5 as control means on the car 5 side to control the operation of the car 5. With this configuration, the safety control device and the control device in the car 5 can bring the car 5 to a stop at the nearest floor or stop the car 5 for emergency, depending on the specifics of a communication error or the type of communication information in the communication controller 1*b*.

The communication controllers 1 hold communication to and from each other over the network 2. When communication over the network 2 is not possible due to a failure in a communication circuit or for other reasons, the communication controllers 1 can hold one-to-one communication over the communication line 3. This means that the communication controllers 1 can communicate minimum signals required to the normal operation of the elevator, for example, some of safety control signals, by one-to-one communication over the communication line 3 when communication over the network 2 is not possible.

One-to-one communication over the communication line 3 may be used in combination with communication over the network 2 even when there is no trouble in communication over the network 2. The network 2 and the communication line 3 may differ from each other in wireless communication method, and may use different frequencies.

The elevator safety system according to the first embodiment includes the battery 14 that is provided in the control panel 4, or in the machine room or the building manager room, as an auxiliary power source. Communication can therefore be continued even when the main power source is lost due to power outage or for other reasons, by switching to the auxiliary power source.

In this case, the auxiliary power source is used to continue only minimum communication required to maintain the functions of the elevator in power outage. The "minimum communication required to maintain the functions of the elevator in power outage" is the communication of signals necessary to rescue trapped passengers, for example, signals of the intercoms 13 and an emergency alert device. Functions related to communications other than the minimum required communication are cut off from power or shifted to a power saving mode.

When the main power source recovers, all communications are resumed by switching from the auxiliary power source to the main power source. The battery 14 may be provided in the communication controller 1*a* and the communication controller 1*b* each, or may be shared by the communication controllers 1*a* and 1*b* through a power line running between the communication controllers 1*a* and 1*b*.

The features and effects of the elevator safety system according to the first embodiment are summed up as follows.

(1) Regarding the Reduction in Number of Communication Lines

The elevator safety system according to the first embodiment has a configuration in which a serial communication network (corresponding to the network 2) connects, to each other, a first communication controller (corresponding to the communication controller 1*b*) connected to pieces of elevator equipment and a second communication controller (corresponding to the communication controller 1*a*) connected to a control device configured to control the operation of an elevator car. The number of communication lines is consequently reduced from the case in which pieces of elevator equipment installed in the car and other places are each connected to a control panel separately.

(2) Regarding Securing Communication Functions in the Event of a Network Failure The elevator safety system according to the first embodiment has a configuration in which an individual communication line (corresponding to the communication line 3) provided separately from the serial communication network connects the first communication controller and the second communication controller to each other. As a result, minimum signals required to the normal operation of the elevator can be communicated even when communication over the network is not possible due to a failure in a communication circuit or for other reasons, by one-to-one communication that uses the individual communication line.

(3) Regarding Elevator Operation Control in Accordance with the Result of Error Ratio Measurement The elevator safety system according to the first embodiment has a configuration in which the error ratio is calculated from the number of error bits in a safety control signal contained in messages that are transmitted in succession and received over the network, and the elevator can be switched to an operation state in accordance with the error ratio. The safety is consequently ensured with respect to the safety control signal irrespective of the environment of individual buildings.

In short, according to the elevator safety system of the first embodiment, the quantity of wires can be reduced while ensuring safety irrespective of the environment of individual buildings. The elevator safety system according to the first embodiment is also free from a limit that is put to the allotted data amount, or a user data area, by designing an elevator safety system for a too severe noise environment, and free from an increase in processing load that is caused by the excessive use of error detection codes.

(4) Regarding Transmission Control Based on Priority Level

The elevator safety system according to the first embodiment has a configuration in which transmission is controlled by following a transmission schedule that is based on the priority level of a signal transmitted over the network. As a result, successful communication of a signal related to safety control and other signals that are assigned a high priority level is ensured even more.

(5) Regarding the Function of Dynamically Adjusting the Schedule of a Transmission Signal The elevator safety system according to the first embodiment has a configuration in which the communication state of the network is monitored and the schedule of a transmission signal is determined dynamically based on how often communication errors are detected. Network communication suited to the communication quality is accomplished as a result. The elevator safety system according to the first embodiment further has a configuration in which the schedule of a transmission signal is determined based on the available bandwidth of a communication path in the network. Network communication suited to the communication quality is accomplished as a result.

(6) Regarding the Error Detection Function

The elevator safety system according to the first embodiment has a configuration in which error detection information is attached to safety control-related information that is transmitted, and error detection is conducted with the use of the error detection information when the safety control-related information is received. The level of communication reliability that is necessary for safety control is consequently secured.

(7) Regarding Switching Car Operation Control in Conjunction with a Communication Error State The elevator safety system according to the first embodiment has a configuration in which a communication error state can be identified when a communication error occurs, by determining the level of the communication error and the type of communication information. The control device configured to control the elevator car can consequently execute appropriate operation control in accordance with the error state. Specifically, appropriate operation control in accordance with the communication error state can be selected from emergency stop, nearest floor stop, speed limitation, and the like, thereby ensuring the safety of the elevator car despite a communication error.

When an error state is detected by the first communication controller, which is connected to pieces of elevator equipment, the appropriate operation control described above can be performed by notifying the detected error state from the first communication controller via the individual communication line to the second communication controller, which is connected to the control device configured to control the operation of the car.

When the elevator safety system has a configuration in which the control device configured to control the operation of the car is connected to the first communication controller, the appropriate operation control described above can be performed by notifying the result of the error state determination that is executed by the first communication control to the control device.

(8) Regarding Securing Reliability in the Event of a Loss of the Main Power Source The elevator safety system according to the first embodiment has a configuration in which power can be supplied via an auxiliary power source when the main power source is lost. As a result, high priority communication can be held with the use of the auxiliary power source even when the main power source is lost, and the minimum reliability of elevator communication is secured.

Second Embodiment

The error ratio is determined based on CRC determination about the safety message 71 in the case described in the first embodiment. In contrast, a second embodiment of the present invention describes a case in which the error ratio measurement data 88 is used instead of the safety message 71, and the error ratio is measured without CRC determination.

The communication controllers 1 in the second embodiment differ from the configuration of the communication controllers 1 in the first embodiment in the specifics of the processing executed by the error ratio measurement data creation unit 41 and the processing executed by the error ratio measurement unit 42. The description given below focuses on the differences.

The error ratio measurement data creation unit 41 creates the error ratio measurement data 88 in a bit pattern that is determined in advance by the sequence number of the safety message. Specifically, the error ratio measurement data creation unit 41 creates the error ratio measurement data 88 so that four patterns of data as those illustrated in FIG. 5, for example, are transmitted.

Figure 12:
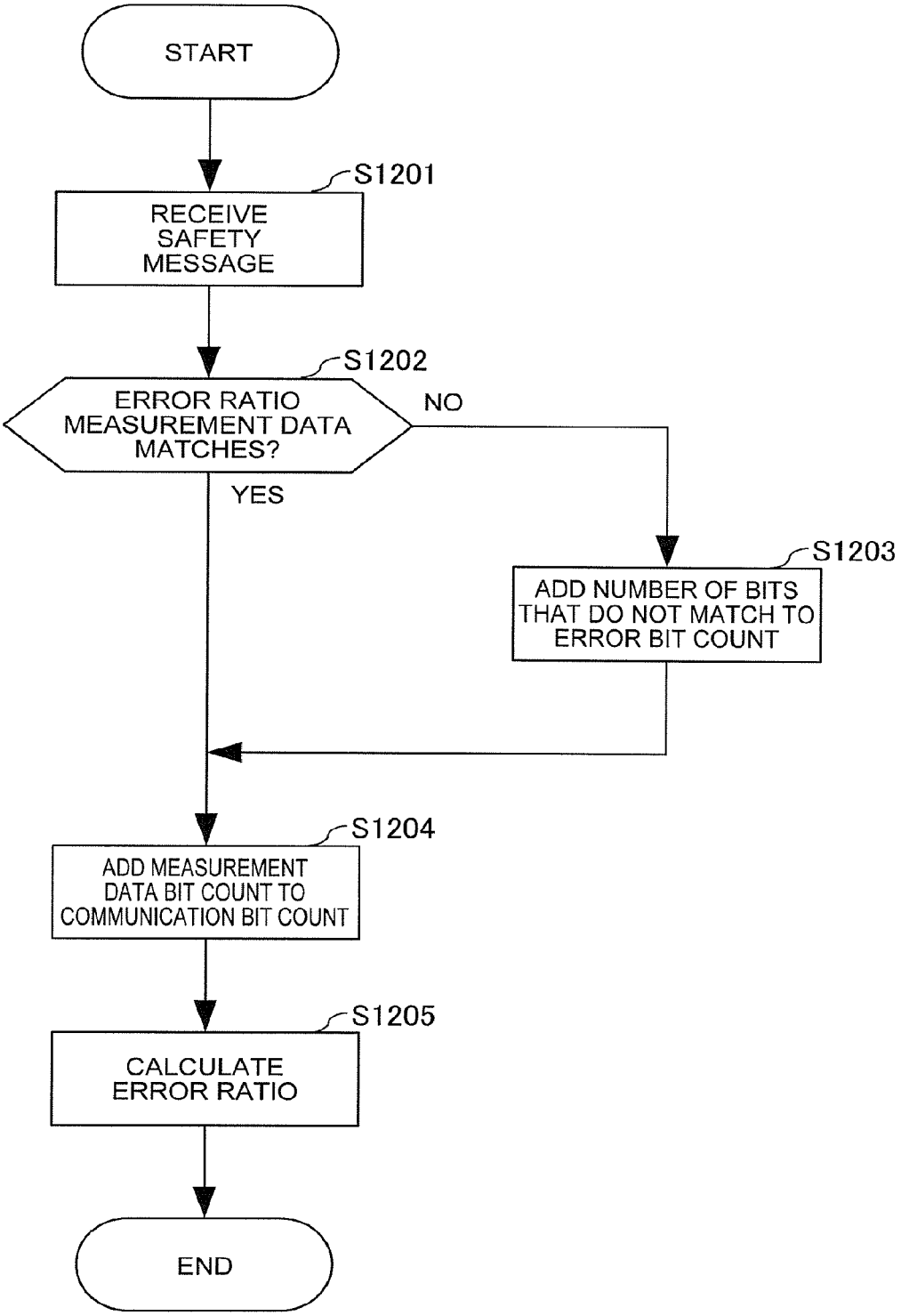
FIG. 12 is a flow chart for illustrating a series of processing steps that is executed by an error ratio measurement unit in a second embodiment of the present invention.

FIG. 12 is a flow chart for illustrating a series of processing steps that is executed by the error ratio measurement unit 42 in the second embodiment of the present invention. First, in Step S1201, the error ratio measurement unit 42 receives the safety message 71 and the error ratio measurement data 88.

Next, in Step S1202, the error ratio measurement unit 42 compares the received error ratio measurement data 88 to a bit pattern that is determined in advance by the sequence number of the received safety message. When the two do not match, the processing proceeds to Step S1203. In Step S1203, the error ratio measurement unit 42 adds the number of mismatched bits to the count as an error bit count. The processing then proceeds to Step S1204. When the two match, on the other hand, the processing proceeds to Step S1204 without executing the addition processing of Step S1203.

In Step S1204, the error ratio measurement unit 42 adds the total number of bits of the error ratio measurement data to the count as a communication bit count. In Step S1205, the error ratio measurement unit 42 calculates the error ratio by using the following expression.

Error ratio=error bit count/communication bit count

The features and effects of the elevator safety system according to the second embodiment are summed up as follows.

(1) Regarding the Lightening of the Calculation Load that is Caused by Error Ratio Calculation The elevator safety system according to the second embodiment has a configuration in which the error ratio can be calculated without CRC determination, by transmitting, in succession, pieces of error ratio measurement data that are determined in advance. The error ratio can consequently be measured even when an error that has occurred is of a type that is missed by CRC. The processing load is also lightened than in the CRC determination processing.

Third Embodiment

Figure 13:
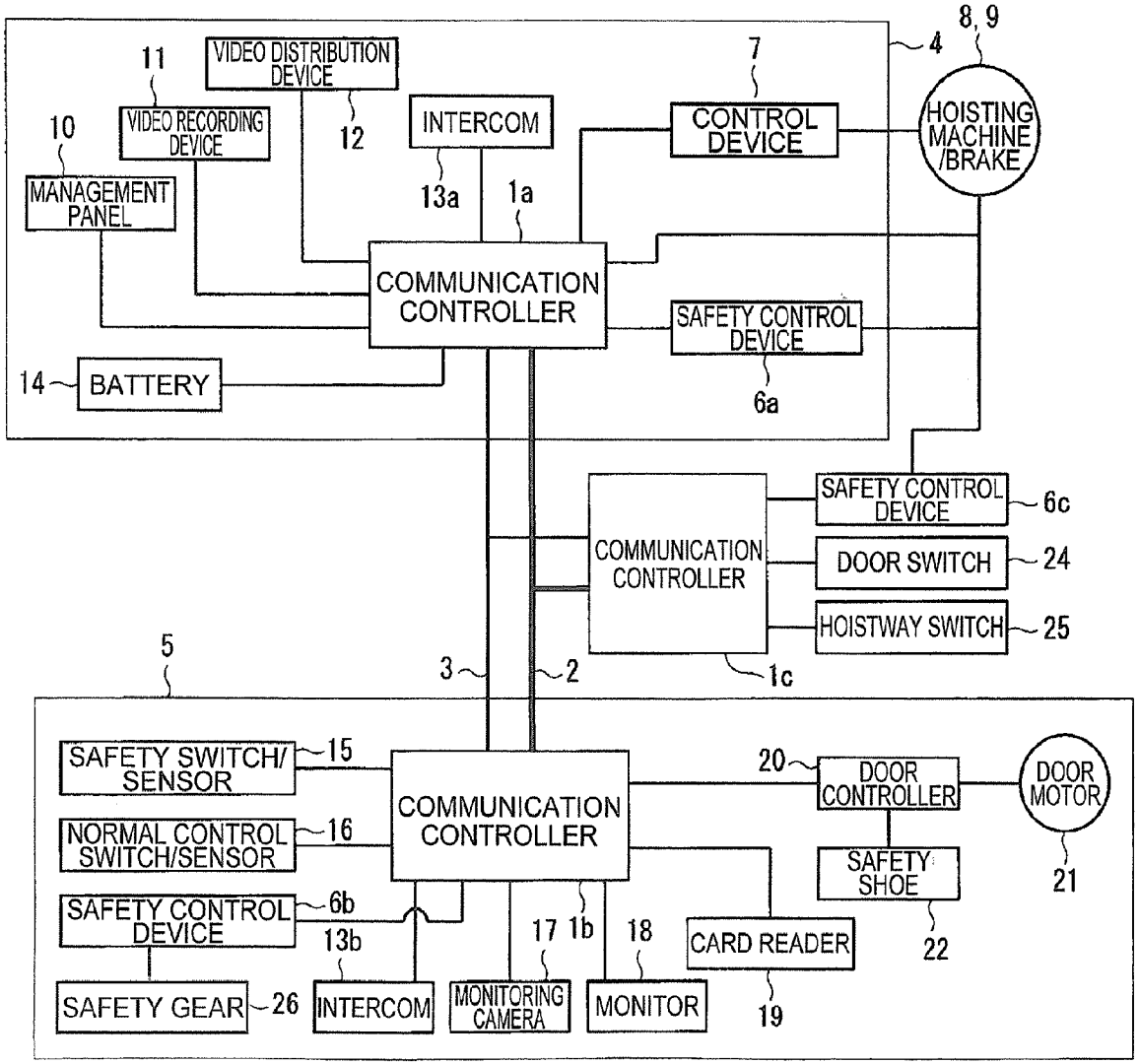
FIG. 13 is a block diagram for illustrating the configuration of an elevator safety system according to a third embodiment of the present invention.

FIG. 13 is a block diagram for illustrating the configuration of an elevator safety system according to a third embodiment of the present invention. The elevator safety system according to the third embodiment differs from the configuration of the elevator safety system according to the first embodiment or the second embodiment in that components given below are further included.

The elevator safety system further includes a communication controller 1*c* installed in a hoistway 23, a hoistway switch 25, a door switch 24 of a landing, and a safety control device 6*c*.

The elevator safety system further includes a safety control device 6*b* connected to the communication controller 1*b* installed in the car 5, and a safety gear 26 controlled by the safety control device 6*b*.

In other words, the elevator safety system according to the third embodiment includes the communication controllers 1*a*, 1*b*, and 1*c* and the safety control devices 6*a*, 6*b*, and 6*c* for the control panel 4, the car 5, and the hoistway 23, respectively.

The safety control devices 6*a*, 6*b*, and 6*c* execute safety control operations different from one another. The communication controllers 1*a*, 1*b*, and 1*c* can share information about pieces of elevator equipment that are connected to the communication controllers 1*a*, 1*b*, and 1*c* through communication among one another. The safety control devices 6*a*, 6*b*, and 6*c* connected to the communication controllers 1*a*, 1*b*, and 1*c* can thus execute safety control individually while sharing the information about the elevator equipment.

For example, a case in which the result of detection by the door switch 24 of the landing or the hoistway switch 25 is transmitted from the communication controller 1*c* installed in the hoistway to the communication controller 1*b* of the car 5 is considered. The communication controller 1*b* in this case can execute safety control in which the safety gear 26 installed in the car 5 is activated when an unintended movement of the car 5 is detected.

The safety control devices 6*a*, 6*b*, and 6*c* can monitor the states of one another by exchanging data among the safety control devices 6*a*, 6*b*, and 6*c*. When a failure occurs in one of the safety control devices, the other safety control devices can consequently restrain the movement of the car 5. A configuration capable of backing up safety control is thus accomplished.

The features and effects of the elevator safety system according to the third embodiment are summed up as follows.

(1) The elevator safety system according to the third embodiment has a configuration in which one communication controller and one safety control device are provided for each of the control panel, the car, and the hoistway, and information can be shared by holding inter-communication among the communication controllers. As a result, the safety control can be backed up, and the functions of the safety control devices in the event of an abnormality are improved further while reducing the quantity of wires.

In any of the first embodiment to the third embodiment, the safety communication units 35 and the safety control signal interfaces 36 in the communication controllers 1*a*, 1*b*, and 1*c* may be included in the safety control devices 6, 6*a*, 6*b*, and 6*c*.

Information attached to a safety control signal by the safety communication unit 35 is not limited to a CRC code. Other than CRC, a parity bit, a BHC code, a Reed-Solomon code, an error correction code, and the like can be used to obtain the same effect.

The invention claimed is:

1. An elevator safety system, comprising:

a plurality of communication controllers connected to equipment of an elevator and configured to communicate, over a network, signals of a plurality of types including a safety control signal;

a control device connected to a first communication controller, which is one of the plurality of communication controllers, and is configured to execute operation control of the elevator, wherein each of the plurality of communication controllers comprises an error ratio measurement instrument configured to measure error ratio of the network, based on a bit error of data that is received over the network, and wherein the control device is configured to:

start communication of the safety control signal when the error ratio is less than a safety communication start determination value before communication of the safety control signal is started; and execute the operation control by switching the operation state of the elevator in accordance with the error ratio measured by the error ratio measurement instrument that is included in the first communication controller, before beginning of and during the communication of the safety control signal.

2. An elevator safety system according to claim 1, wherein the first communication controller is connected to each of the rest of the plurality of communication controllers by an individual communication line, and is configured to hold one-to-one communication over the individual communication line, and wherein the control device is configured to execute the operation control by switching an operation state of the elevator in accordance with the error ratio that is measured by the error ratio measurement instrument included in one of the rest of the plurality of communication controllers and that is obtained over the network or through the one-to-one communication, before the beginning of and during the communication of the safety control signal.

3. An elevator safety system according to claim 1, wherein the first communication controller is installed in an elevator control panel, wherein each of the rest of the plurality of communication controllers is installed in one of a car, a hoistway, or a landing, wherein each of the plurality of communication controllers is connected to equipment of the elevator that is provided in a place where the each of the plurality of communication controllers is installed, and is individually connected to a safety control device that is provided in the place where the each of the plurality of communication controllers is installed, and wherein each of the plurality of communication controllers is configured to share information about all pieces of elevator equipment through communication over the network, and to individually execute, based on the shared information, safety control by using the safety control device that is connected to the each of the plurality of communication controllers.

4. An elevator safety system according to claim 2, wherein the first communication controller is installed in an elevator control panel, wherein each of the rest of the plurality of communication controllers is installed in one of a car, a hoistway, or a landing, wherein each of the plurality of communication controllers is connected to equipment of the elevator that is provided in a place where the each of the plurality of communication controllers is installed, and is individually connected to a safety control device that is provided in the place where the each of the plurality of communication controllers is installed, and wherein each of the plurality of communication controllers is configured to share information about all pieces of elevator equipment through communication over the network, and to individually execute, based on the shared information, safety control by using the safety control device that is connected to the each of the plurality of communication controllers.

5. An elevator safety system according to claim 1, wherein the control device is configured to bring a car to a stop at a nearest floor when the error ratio exceeds a first threshold, and to stop the car for emergency when the error ratio exceeds a second threshold, which is a value larger than the first threshold, in the operation control that is executed by switching the operation state of the elevator in accordance with the error ratio.

6. An elevator safety system according to claim 2, wherein the control device is configured to bring a car to a stop at a nearest floor when the error ratio exceeds a first threshold, and to stop the car for emergency when the error ratio exceeds a second threshold, which is a value larger than the first threshold, in the operation control that is executed by switching the operation state of the elevator in accordance with the error ratio.

7. An elevator safety system according to claim 3, wherein the control device is configured to bring a car to a stop at a nearest floor when the error ratio exceeds a first threshold, and to stop the car for emergency when the error ratio exceeds a second threshold, which is a value larger than the first threshold, in the operation control that is executed by switching the operation state of the elevator in accordance with the error ratio.

8. An elevator safety system according to claim 1, wherein each of the plurality of communication controllers is configured to:

intentionally change error ratio measurement data, which is known data, and transmit the changed error ratio measurement data in the safety control signal over the network; and receive the changed error ratio measurement data by looping back the changed error ratio measurement data, and perform self-diagnosis of the error ratio measurement instrument by checking an error ratio of the changed error ratio measurement data to the error ratio measurement data, the error ratio being measured by the error ratio measurement instrument.

9. An elevator safety system according to claim 2, wherein each of the plurality of communication controllers is configured to:

intentionally change error ratio measurement data, which is known data, and transmit the changed error ratio measurement data in the safety control signal over the network; and receive the changed error ratio measurement data by looping back the changed error ratio measurement data, and perform self-diagnosis of the error ratio measurement instrument by checking an error ratio of the changed error ratio measurement data to the error ratio measurement data, the error ratio being measured by the error ratio measurement instrument.

10. An elevator safety system according to claim 3, wherein each of the plurality of communication controllers is configured to:

intentionally change error ratio measurement data, which is known data, and transmit the changed error ratio measurement data in the safety control signal over the network; and receive the changed error ratio measurement data by looping back the changed error ratio measurement data, and perform self-diagnosis of the error ratio measurement instrument by checking an error ratio of the changed error ratio measurement data to the error ratio measurement data, the error ratio being measured by the error ratio measurement instrument.

11. An elevator safety system according to claim 1, wherein a transmission-side communication controller out of the plurality of communication controllers is configured to intentionally change error ratio measurement data, which is known data, and transmit the changed error ratio measurement data in the safety control signal over the network, and wherein a reception-side communication controller out of the plurality of communication controllers is configured to receive the changed error ratio measurement data over the network, and perform self-diagnosis of the error ratio measurement instrument by checking an error ratio of the changed error ratio measurement data to the error ratio measurement data, the error ratio being measured by the error ratio measurement instrument.

12. An elevator safety system according to claim 2, wherein a transmission-side communication controller out of the plurality of communication controllers is configured to intentionally change error ratio measurement data, which is known data, and transmit the changed error ratio measurement data in the safety control signal over the network, and wherein a reception-side communication controller out of the plurality of communication controllers is configured to receive the changed error ratio measurement data over the network, and perform self-diagnosis of the error ratio measurement instrument by checking an error ratio of the changed error ratio measurement data to the error ratio measurement data, the error ratio being measured by the error ratio measurement instrument.

13. An elevator safety system according to claim 3, wherein a transmission-side communication controller out of the plurality of communication controllers is configured to intentionally change error ratio measurement data, which is known data, and transmit the changed error ratio measurement data in the safety control signal over the network, and wherein a reception-side communication controller out of the plurality of communication controllers is configured to receive the changed error ratio measurement data over the network, and perform self-diagnosis of the error ratio measurement instrument by checking an error ratio of the changed error ratio measurement data to the error ratio measurement data, the error ratio being measured by the error ratio measurement instrument.

14. An elevator safety system according to claim 1, wherein the error ratio measurement instrument is configured to:

determine whether or not there is a transmission error from an error detection code that is included in a message received over the network;

determine, from information that is included in a safety message including the safety control signal in the received message, whether or not the safety message is being transmitted in succession;

calculate an error bit count of the received safety message that contains an error, by comparison to a successively transmitted normal message;

temporarily store a safety message that is determined as having a transmission error and that is determined as not being one of messages transmitted in succession, and calculate the error bit count of the temporarily stored safety message when a normal safety message without transmission errors is next received; and measure, for every one of safety messages transmitted in succession, a proportion of the error bit count to a total bit count as the error ratio.

15. An elevator safety system according to claim 2, wherein the error ratio measurement instrument is configured to:

determine whether or not there is a transmission error from an error detection code that is included in a message received over the network;

determine, from information that is included in a safety message including the safety control signal in the received message, whether or not the safety message is being transmitted in succession;

calculate an error bit count of the received safety message that contains an error, by comparison to a successively transmitted normal message;

temporarily store a safety message that is determined as having a transmission error and that is determined as not being one of messages transmitted in succession, and calculate the error bit count of the temporarily stored safety message when a normal safety message without transmission errors is next received; and measure, for every one of safety messages transmitted in succession, a proportion of the error bit count to a total bit count as the error ratio.

16. An elevator safety system according to claim 3, wherein the error ratio measurement instrument is configured to:

determine whether or not there is a transmission error from an error detection code that is included in a message received over the network;

determine, from information that is included in a safety message including the safety control signal in the received message, whether or not the safety message is being transmitted in succession;

calculate an error bit count of the received safety message that contains an error, by comparison to a successively transmitted normal message;

temporarily store a safety message that is determined as having a transmission error and that is determined as not being one of messages transmitted in succession, and calculate the error bit count of the temporarily stored safety message when a normal safety message without transmission errors is next received; and measure, for every one of safety messages transmitted in succession, a proportion of the error bit count to a total bit count as the error ratio.

17. An elevator safety system according to claim 1, wherein each of the plurality of communication controllers is configured to include known error ratio measurement data that is associated with a sequence number in the safety control signal, and transmit messages of the safety control signal in succession, and wherein the error ratio measurement instrument is configured to check, for the safety control signal of which messages are transmitted in succession, error ratio measurement data that is associated with the attached sequence number, and measure a proportion of the error bit count to a total bit count as the error ratio.

18. An elevator safety system according to claim 2, wherein each of the plurality of communication controllers is configured to include known error ratio measurement data that is associated with a sequence number in the safety control signal, and transmit messages of the safety control signal in succession, and wherein the error ratio measurement instrument is configured to check, for the safety control signal of which messages are transmitted in succession, error ratio measurement data that is associated with the attached sequence number, and measure a proportion of the error bit count to a total bit count as the error ratio.

19. An elevator safety system according to claim 3, wherein each of the plurality of communication controllers is configured to include known error ratio measurement data that is associated with a sequence number in the safety control signal, and transmit messages of the safety control signal in succession, and wherein the error ratio measurement instrument is configured to check, for the safety control signal of which messages are transmitted in succession, error ratio measurement data that is associated with the attached sequence number, and measure a proportion of the error bit count to a total bit count as the error ratio.

* * * * *